US010685641B2

(12) United States Patent
Asada et al.

(10) Patent No.: US 10,685,641 B2
(45) Date of Patent: Jun. 16, 2020

(54) SOUND OUTPUT DEVICE, SOUND OUTPUT METHOD, AND SOUND OUTPUT SYSTEM FOR SOUND REVERBERATION

(71) Applicant: SONY CORPORATION, Tokyo (JP)

(72) Inventors: Kohei Asada, Kanagawa (JP); Go Igarashi, Tokyo (JP); Koji Nageno, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/069,631

(22) PCT Filed: Jan. 5, 2017

(86) PCT No.: PCT/JP2017/000070

§ 371 (c)(1),
(2) Date: Jul. 12, 2018

(87) PCT Pub. No.: WO2017/134973

PCT Pub. Date: Aug. 10, 2017

(65) Prior Publication Data

US 2019/0019495 A1 Jan. 17, 2019

(30) Foreign Application Priority Data

Feb. 1, 2016 (JP) ..... 2016-017019

(51) Int. Cl.
*G10K 15/08* (2006.01)
*H04S 1/00* (2006.01)
(Continued)

(52) U.S. Cl.
CPC ..... *G10K 15/08* (2013.01); *G10K 15/10* (2013.01); *H04R 1/1016* (2013.01); *H04R 1/34* (2013.01);
(Continued)

(58) Field of Classification Search
CPC .... H04R 1/1016; H04R 29/001; H04R 25/50; H04R 25/552; H04R 5/033; H04R 1/34;
(Continued)

(56) References Cited

U.S. PATENT DOCUMENTS 5,371,799 A 12/1994 Lowe et al.
6,681,022 B1 1/2004 Puthuff et al.
(Continued)

FOREIGN PATENT DOCUMENTS

CN 2681501 Y 2/2005
CN 101138273 A 3/2008
(Continued)

OTHER PUBLICATIONS

International Search Report and Written Opinion of PCT Application No. PCT/JP2017/000070, dated Mar. 28, 2017, 08 pages of ISRWO.
(Continued)

*Primary Examiner* — Jason R Kurr
(74) *Attorney, Agent, or Firm* — Chip Law Group

(57) ABSTRACT

According to the present disclosure, a sound output device includes a sound acquisition part that acquires a sound signal generated from an ambient sound, a reverb process part that performs a reverb process on the sound signal, and a sound output part that outputs a sound generated from the sound signal subjected to the reverb process, to a vicinity of an ear of a listener. This configuration allows a listener to hear sound acquired in real time to which desired reverberation is added.

1 Claim, 17 Drawing Sheets

(51) Int. Cl.

| | |
|---|---|
| ***H04R 5/033*** | (2006.01) |
| ***H04S 7/00*** | (2006.01) |
| ***H04R 1/34*** | (2006.01) |
| ***G10K 15/10*** | (2006.01) |
| ***H04R 1/10*** | (2006.01) |
| ***H04R 29/00*** | (2006.01) |

(52) U.S. Cl.
CPC ..... *H04R 5/033* (2013.01); *H04R 29/001* (2013.01); *H04S 1/00* (2013.01); *H04S 7/306* (2013.01); *H04R 1/10* (2013.01)

(58) Field of Classification Search
CPC ... H04R 1/10; H04S 7/305; H04S 1/00; H04S 7/306; G10K 15/08; G10K 15/10
USPC ..... 381/63
See application file for complete search history.

(56) References Cited

U.S. PATENT DOCUMENTS

| | | | | |
|---|---|---|---|---|
| 2003/0215104 | A1* | 11/2003 | Yamada | H04S 1/005 381/309 |
| 2007/0127750 | A1* | 6/2007 | Glatt | H04R 25/30 381/312 |
| 2008/0013767 | A1* | 1/2008 | Olsen | H04R 25/654 381/328 |
| 2008/0273708 | A1* | 11/2008 | Sandgren | G10K 15/08 381/63 |
| 2011/0150248 | A1 | 6/2011 | Macours | |
| 2014/0126756 | A1 | 5/2014 | Gauger, Jr. | |
| 2015/0063553 | A1 | 3/2015 | Gleim | |
| 2015/0139474 | A1* | 5/2015 | Henry | H04R 1/1016 381/380 |
| 2015/0271602 | A1 | 9/2015 | Gauger, Jr. | |
| 2015/0280669 | A1* | 10/2015 | Vilermo | H04R 5/033 381/107 |
| 2015/0373474 | A1 | 12/2015 | Kraft et al. | |
| 2016/0353196 | A1* | 12/2016 | Baker | H04R 1/1083 |
| 2017/0200442 | A1 | 7/2017 | Yamabe et al. | |
| 2018/0035233 | A1* | 2/2018 | Fielder | H04S 3/004 |
| 2019/0019495 | A1 | 1/2019 | Asada et al. | |

FOREIGN PATENT DOCUMENTS

| | | | |
|---|---|---|---|
| CN | 101454825 | A | 6/2009 |
| CN | 202514043 | U | 10/2012 |
| CN | 104871559 | A | 8/2015 |
| CN | 106664473 | A | 5/2017 |
| CN | 108141684 | A | 6/2018 |
| EP | 1275269 | A2 | 1/2003 |
| EP | 2915341 | A1 | 9/2015 |
| EP | 3091754 | A1 | 11/2016 |
| EP | 3163902 | A1 | 5/2017 |
| EP | 3361755 | A1 | 8/2018 |
| EP | 3413590 | A1 | 12/2018 |
| GB | 2361395 | A | 10/2001 |
| JP | 06-245299 | A | 9/1994 |
| JP | 2000-097762 | A | 4/2000 |
| JP | 2007-202020 | A | 8/2007 |
| JP | 2016-500994 | A | 1/2016 |
| WO | 2000/005924 | A1 | 2/2000 |
| WO | 01/78486 | A2 | 10/2001 |
| WO | 2014/071013 | A1 | 5/2014 |
| WO | 2016/002358 | A1 | 1/2016 |
| WO | 2017/061218 | A1 | 4/2017 |

OTHER PUBLICATIONS

Extended European Search Report of EP Patent Application No. 17747137.2, dated Nov. 15, 2018, 09 pages.

Extended European Search Report of EP Application No. 19200583.3, dated Jan. 24, 2020, 06 pages.

Office Action for CN Patent Application No. 201780008155.1, dated Mar. 30, 2020, 08 pages of Office Action and 11 pages of English Translation.

* cited by examiner

SOUND OUTPUT DEVICE, SOUND OUTPUT METHOD, AND SOUND OUTPUT SYSTEM FOR SOUND REVERBERATION

CROSS REFERENCE TO RELATED APPLICATIONS

This application is a U.S. National Phase of International Patent Application No. PCT/JP2017/000070 filed on Jan. 5, 2017, which claims priority benefit of Japanese Patent Application No. JP 2016-017019 filed in the Japan Patent Office on Feb. 1, 2016. Each of the above-referenced applications is hereby incorporated herein by reference in its entirety.

TECHNICAL FIELD

The present disclosure relates to a sound output device, a sound output method, a program, and a sound system.

BACKGROUND ART

Conventionally, for example, as described in Patent Literature 1 listed below, a technology of reproducing reverberation of an impulse response by measuring the impulse response in a predetermined environment and convolving an input signal into the obtained impulse response is known.

CITATION LIST

Patent Literature

Patent Literature 1: JP 2000-97762A

DISCLOSURE OF INVENTION

Technical Problem

However, according to the technology described in Patent Literature 1, the impulse response that is acquired in advance through the measurement is convolved into a digital audio signal to which a user wants to add a reverberant sound. Therefore, the technology described in Patent Literature 1 does not assume addition of a spatial simulation transfer function process (for example, reverberation or reverb) such as simulation of a predetermined space with respect to sounds acquired in real time.

In view of such circumstances, it is desirable for a listener to hear sounds acquired in real time to which a desired spatial simulation transfer function (reverberation) is added. Note that, hereinafter, the spatial simulation transfer function is referred to as a "reverb process" to simplify the explanation. Note that, hereinafter, the spatial simulation transfer function is referred to as a "reverb process" to simplify the explanation. Note that, not only in the case where there are excessive reverberation components, but also in the case where there are a few reverberation components such as a small space simulation, the a transfer function is referred to as a "reverb process" to simulate a space as long as it is based on a transfer function between two points in the space.

Solution to Problem

According to the present disclosure, there is provided a sound output device including: a sound acquisition part configured to acquire a sound signal generated from an ambient sound; a reverb process part configured to perform a reverb process on the sound signal; and a sound output part configured to output a sound generated from the sound signal subjected to the reverb process, to a vicinity of an ear of a listener.

In addition, according to the present disclosure, there is provided a sound output method including: acquiring a sound signal generated from an ambient sound; performing a reverb process on the sound signal; and outputting a sound generated from the sound signal subjected to the reverb process, to a vicinity of an ear of a listener.

In addition, according to the present disclosure, there is provided a program causing a computer to function as: a means for acquiring a sound signal generated from an ambient sound; a means for performing a reverb process on the sound signal; and a means for outputting a sound generated from the sound signal subjected to the reverb process, to a vicinity of an ear of a listener.

In addition, according to the present disclosure, there is provided a sound system including: a first sound output device including a sound acquisition part configured to acquire sound environment information that indicates an ambient sound environment, a sound environment information acquisition part configured to acquire, from a second sound output device, sound environment information that indicates a sound environment around the second sound output device that is a communication partner, a reverb process part configured to perform a reverb process on a sound signal acquired by the sound acquisition part, in accordance with the sound environment information, and a sound output part configured to output a sound generated from the sound signal subjected to the reverb process, to an ear of a listener; and the second sound output device including a sound acquisition part configured to acquire sound environment information that indicates an ambient sound environment, a sound environment information acquisition part configured to acquire sound environment information that indicates a sound environment around the first sound output device that is a communication partner, a reverb process part configured to perform a reverb process on a sound signal acquired by the sound acquisition part, in accordance with the sound environment information, and a sound output part configured to output a sound generated from the sound signal subjected to the reverb process, to an ear of a listener.

Advantageous Effects of Invention

As described above, according to the present disclosure, it is possible for a listener to hear sound acquired in real time to which desired reverberation is added. Note that the effects described above are not necessarily limitative. With or in the place of the above effects, there may be achieved any one of the effects described in this specification or other effects that may be grasped from this specification.

BRIEF DESCRIPTION OF DRAWINGS

FIG. 7 is used.

MODE(S) FOR CARRYING OUT THE INVENTION

Figure 1:
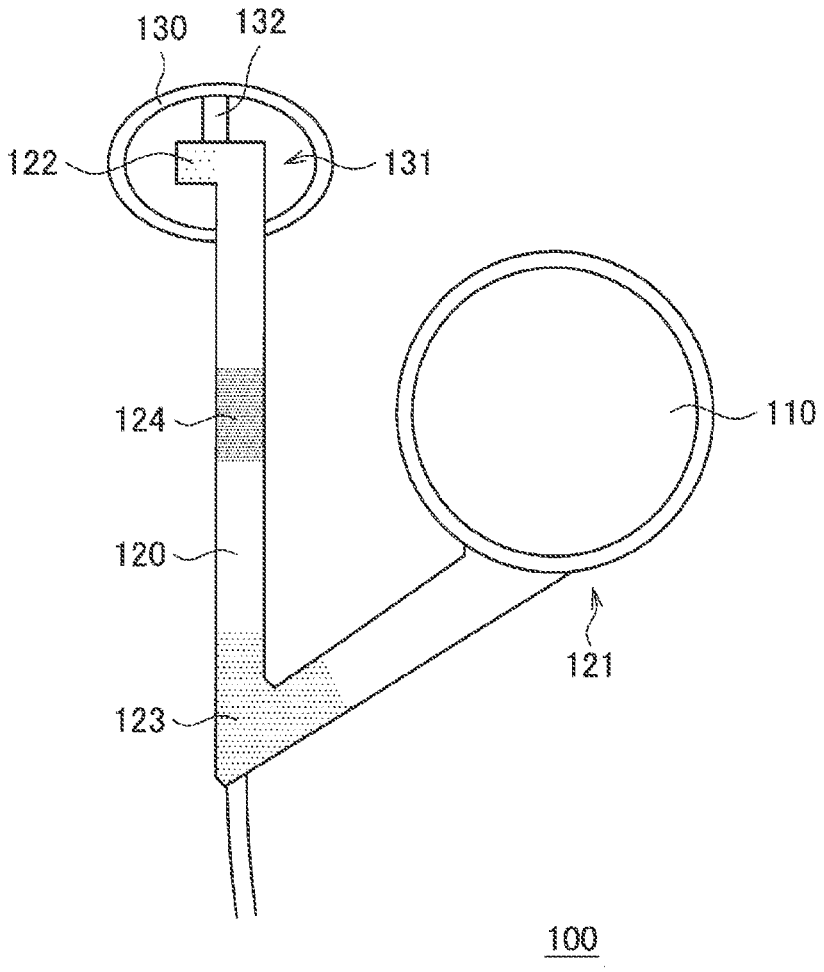
FIG. 1 is a schematic diagram illustrating a configuration of a sound output device according to an embodiment of the present disclosure.

Hereinafter, (a) preferred embodiment(s) of the present disclosure will be described in detail with reference to the appended drawings. Note that, in this specification and the appended drawings, structural elements that have substantially the same function and structure are denoted with the same reference numerals, and repeated explanation of these structural elements is omitted.

Note that, the description is given in the following order.

1. Configuration example of sound output device
2. Reverb process according to present embodiment
3. Application example of system according to present embodiment

1. Configuration Example of Sound Output Device

Figure 2:
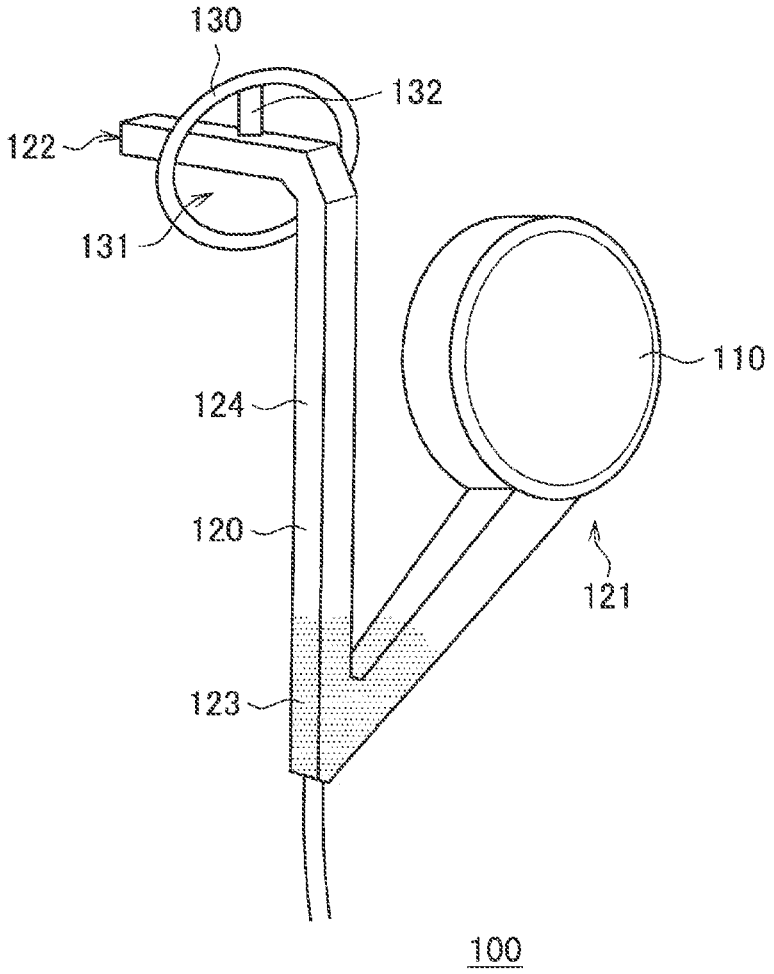
FIG. 2 is a schematic diagram illustrating the configuration of the sound output device according to the embodiment of the present disclosure.

First, with reference to FIG. 1, a schematic configuration of a sound output device according to an embodiment of the present disclosure will be described. FIG. 1 and FIG. 2 are schematic diagrams illustrating a configuration of a sound output device 100 according to the embodiment of the present disclosure. Note that, FIG. 1 is a front view of the sound output device 100, and FIG. 2 is a perspective view of the sound output device 100 when viewed from the left side. The sound output device 100 illustrated in FIG. 1 and FIG. 2 is configured to be worn on a left ear. A sound output device (not illustrated) to be worn on a right ear is configured such that the sound output device to be worn on a right ear is a mirror image of the sound output device to be worn on a left ear.

The sound output device 100 illustrated in FIG. 1 and FIG. 2 includes a sound generation part (sound output part) 110, a sound guide part 120, and a supporting part 130. The sound generation part 110 is configured to generate a sound. The sound guide part 120 is configured to capture the sound generated by the sound generation part 110 through one end 121. The supporting part 130 is configured to support the sound guide part 120 near the other end 122. The sound guide part 120 includes a hollow tube material having an internal diameter of 1 to 5 mm. Both ends of the sound guide part 120 are open ends. The one end 121 of the sound guide part 120 is a sound input hole for a sound generated by the sound generation part 110, and the other end 122 is a sound output hole for that sound. Therefore, one side of the sound guide part 120 is open since the one end 121 is attached to the sound generation part 110.

As described later, the supporting part 130 fits to a vicinity of an opening of an ear canal (such as intertragic notch), and supports the sound guide part 120 near the other end 122 such that the sound output hole at the other end 122 of the sound guide part 120 faces deep in the ear canal. The outside diameter of the sound guide part 120 near at least the other end 122 is smaller than the internal diameter of the opening of the ear canal. Therefore, the other end 122 does not completely cover the ear opening of the listener even in the state in which the other end 122 of the sound guide part 120 is supported by the supporting part 130 near the opening of the ear canal. In other words, the ear opening is open. The sound output device 100 is different from conventional earphones. The sound output device 100 can be referred to as an 'ear-open-style' device.

In addition, the supporting part 130 includes an opening part 131 configured to allow an entrance of an ear canal (ear opening) to open to the outside even in a state in which the sound guide part 120 is supported by the supporting part 130. In the example illustrated in FIG. 1 and FIG. 2, the supporting part 130 has a ring-shaped structure, and connects with a vicinity of the other end 122 of the sound guide part 120 via a stick-shaped supporting member 132 alone. Therefore, all parts of the ring-shaped structure other than them are the opening part 131. Note that, as described later, the supporting part 130 is not limited to the ring-shaped structure. The supporting part 130 may be any shape as long as the supporting part 130 has a hollow structure and is capable of supporting the other end 122 of the sound guide part 120.

The tube-shaped sound guide part 120 captures a sound generated by the sound generation part 110 into the tube from the one end 121 of the sound guide part 120, propagates air vibration of the sound, emits the air vibration to an ear canal from the other end 122 supported by the supporting part 130 near the opening of the ear canal, and transmits the air vibration to an eardrum.

As described above, the supporting part 130 that supports the vicinity of the other end 122 of the sound guide part 130 includes the opening part 131 configured to allow the opening of the ear canal (ear opening) to open to the outside. Therefore, the sound output device 100 does not completely cover an ear opening of a listener even in the state in which the listener is wearing the sound output device 100. Even in the case where a listener is wearing the sound output device 100 and listening to sounds output from the sound generation part 110, the listener can sufficiently hear ambient sounds through the opening part 131.

Note that, although the sound output device 100 according to the embodiment allows an ear opening to open to the outside, the sound output device 100 can suppress sounds generated by the sound generation part 100 (reproduction sound) from leaking to the outside. This is because the sound output device 100 is worn such that the other end 122 of the sound guide part 120 faces deep in the ear canal near the opening of the ear canal, air vibration of a generated sound is emitted near the eardrum, and this enables good sound quality even in the case of reducing output from the sound output part 100.

Figure 3:
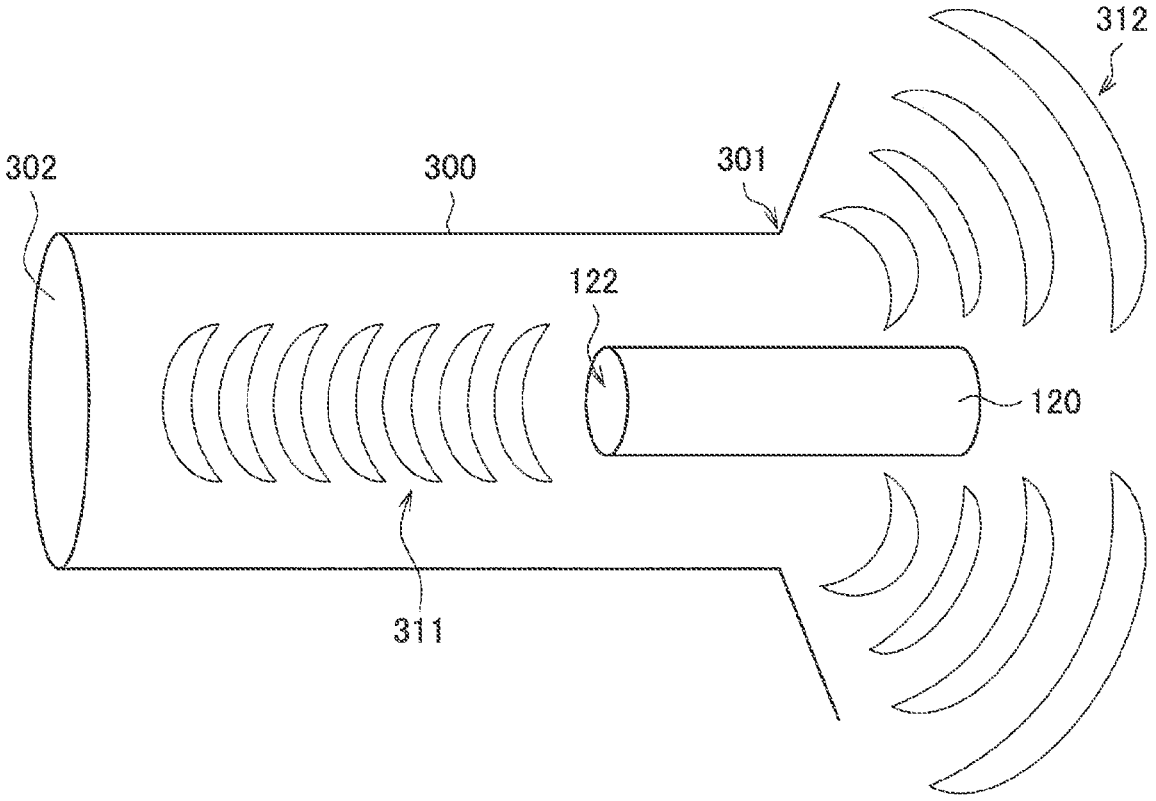
FIG. 3 is a schematic diagram illustrating a situation in which an ear-open-style sound output device outputs sound waves to an ear of a listener.

In addition, directivity of air vibration emitted from the other end 122 of the sound guide part 120 also contributes to prevention of sound leakage. FIG. 3 illustrates a situation in which the ear-open-style sound output device 100 outputs sound waves to an ear of a listener. Air vibration is emitted from the other end 122 of the sound guide part 120 toward the inside of an ear canal. An ear canal 300 is a hole that starts from the opening 301 of the ear canal and ends at an eardrum 302. In general, the ear canal 300 has a length of about 25 to 30 mm. The ear canal 300 is a tube-shaped closed space. Therefore, as indicated by a reference sign 311, air vibration emitted from the other end 122 of the sound part 120 toward deep in the ear canal 300 propagates to the eardrum 302 with directivity. In addition, sound pressure of the air vibration increases in the ear canal 300. Therefore, sensitivity to low frequencies (gain) improves. On the other hand, the outside of the ear canal 300, that is, an outside world is an open space. Therefore, as indicated by a reference sign 312, air vibration emitted to the outside of the ear canal 300 from the other end 122 of the sound guide part 120 does not have directivity in the outside world and rapidly attenuates.

Returning to the description with reference to FIG. 1 and FIG. 2, an intermediate part of the tube-shaped sound guide part 120 has a curved shape from the back side of an ear to the front side of the ear. The curved part is a clip part 123 having an openable-and-closable structure, and is capable of generating pinch force and sandwiching an earlobe. Details thereof will be described later.

In addition, the sound guide part 120 further includes a deformation part 124 between the curved clip part 123 and the other end 122 that is arranged near an opening of an ear canal. When excessive external force is applied, the deformation part 124 deforms such that the other end 122 of the sound guide part 120 is not inserted into deep in the ear canal too much.

When using the sound output device 100 having the above-described configuration, it is possible for a listener to naturally hear ambient sounds even while wearing the sound output device 100. Therefore, it is possible for the listener to fully utilize his/her functions as human beings depending on his/her auditory property, such as recognition of spaces, recognition of dangers, and recognition of conversations and subtle nuances in the conversations.

As described above, in the sound output device 100, the structure for reproduction does not completely cover the vicinity of the opening of an ear. Therefore, ambient sound is acoustically transparent. In a way similar to environments of a person who does not wear general earphones, it is possible to hear an ambient sound as it is, and it is also possible to hear both the ambient sound and sound information or music simultaneously by reproducing desired sound information or music through its pipe or duct shape.

Basically, in-ear earphones that have been widespread in recent years have closed structures that completely cover ear canals. Therefore, a user hears his/her own voice and chewing sound in a different way from a case where his/her ear canals are open to the outside. In many case, this causes users to feel strangeness and uncomfortable. This is because own vocalized sounds and chewing sounds are emitted to closed ear canals though bones and muscles. Therefore, low frequencies of the sounds are enhanced and the enhanced sounds propagate to eardrums. When using the sound output device 100, such phenomenon never occurs. Therefore, it is possible to enjoy usual conversations even while listening to desired sound information.

As described above, the sound output device 100 according to the embodiment passes an ambient sound as sound waves without any change, and transmits the presented sound or music to a vicinity of an opening of an ear via the tube-shaped sound guide part 120. This enables a user to experience the sound or music while hearing ambient sounds.

Figure 4:
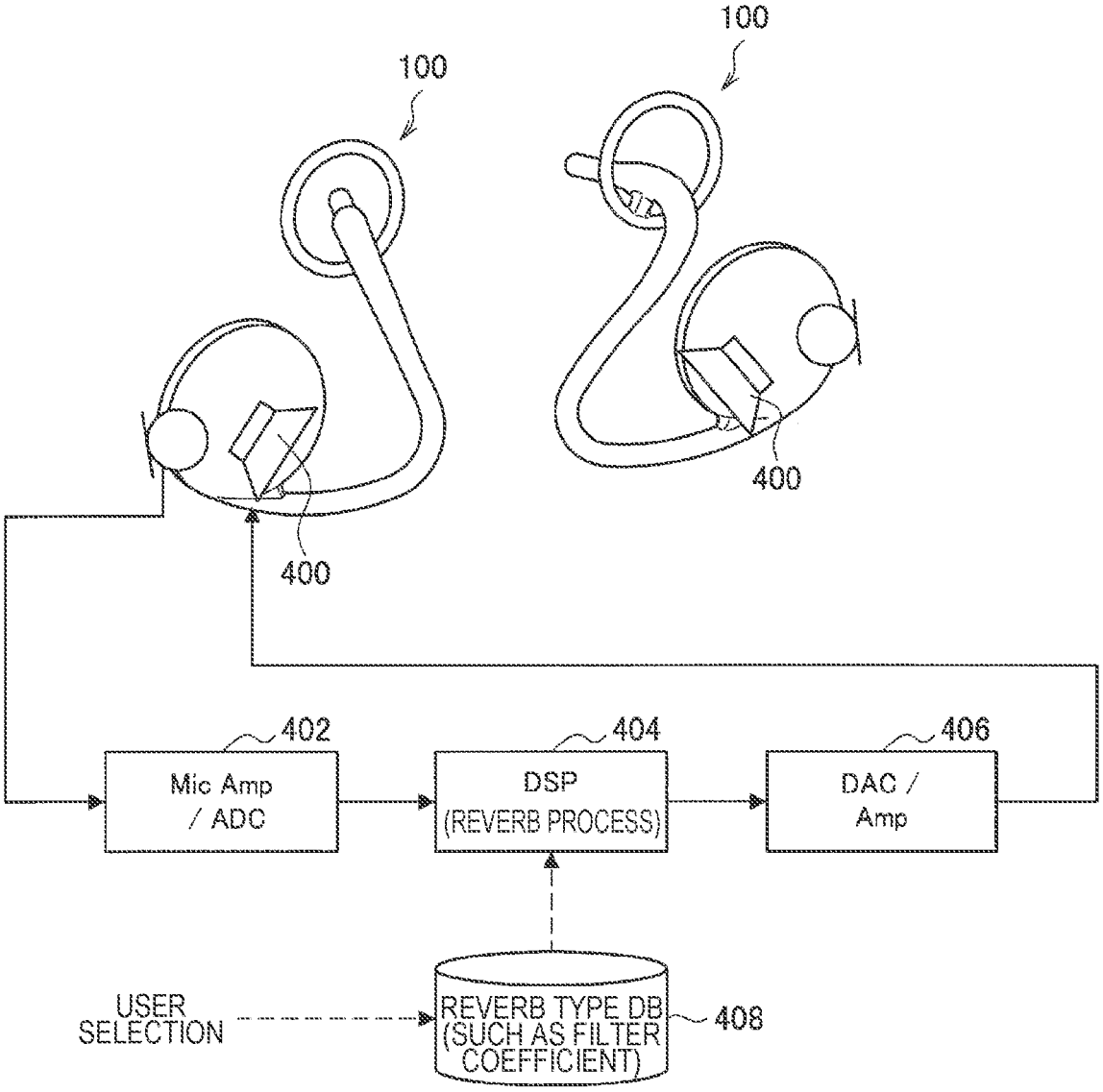
FIG. 4 is a schematic diagram illustrating a basic system according to the present disclosure.

FIG. 4 is a schematic diagram illustrating a basic system according to the present disclosure. As illustrated in FIG. 4, each of the left sound output device 100 and the right sound output device 100 is provided with a microphone (sound acquisition part) 400. A microphone signal output from the microphone 400 undergoes amplification performed by a microphone amplifier/ADC 402, undergoes AD conversion, undergoes a DSP process (reverb process) performed by a DSP (or MPU) 404, undergoes amplification performed by a DAC/amplifier (or digital amplifier) 406, undergoes DA conversion, and then is reproduced by the sound output device 100. Accordingly, a sound is generated from the sound generation part 100, and the user can hear the sound by his/her ear via the sound guide part 120. In FIG. 4, the left microphone 400 and the right microphone 400 are provided independently, and a microphone signal undergoes independent reverb processes performed by the respective sides. Note that, it is possible for the sound generation part 110 of the sound output device 100 to include the respective structural elements such as the microphone amplifier/ADC 402, the DSP 404, and the DAC/amplifier 406. In addition, such structural elements in the respective blocks illustrated FIG. 4 can be implemented by a circuit (hardware) or a central processing unit such as a CPU and a program (software) for causing it to function.

Figure 5:
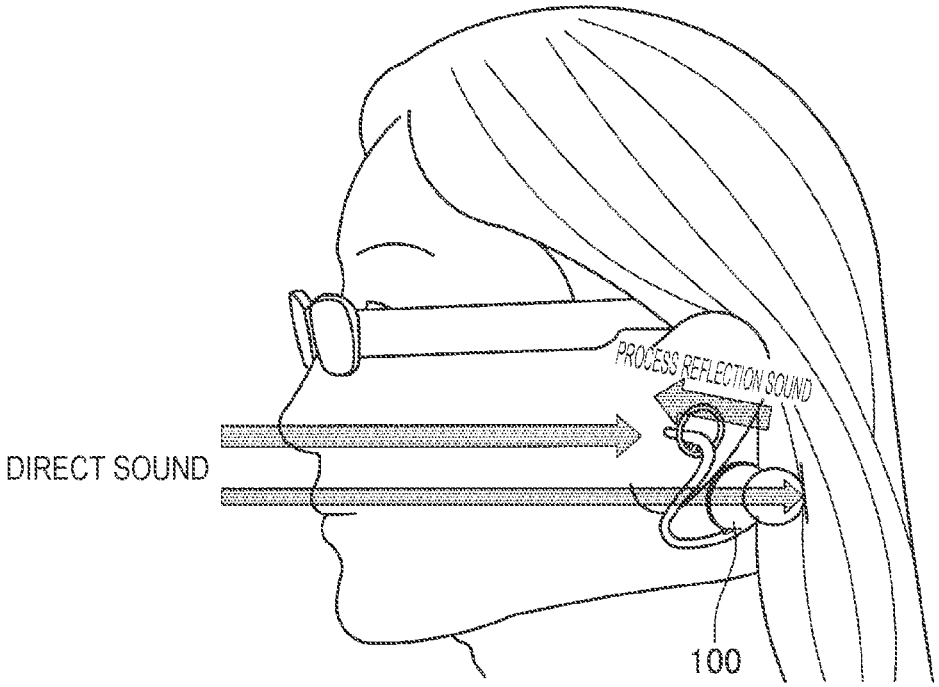
FIG. 5 is a schematic diagram illustrating a user who is wearing a sound output device of the system illustrated in FIG. 4.

FIG. 5 is a schematic diagram illustrating a user who is wearing the sound output device 100 of the system illustrated in FIG. 4. In this case, in a user experience, an ambient sound that directly enters into an ear canal and a sound that is collected by the microphone 400, subjected to a signal process, and then enters into the sound guide part 120 are spatial-acoustically added in an ear canal path, as illustrated in FIG. 5. Therefore, a combined sound of the both sounds reaches an eardrum, and it is possible to recognize a sound field and a space on the basis of the combined sound.

As described above, the DSP 404 functions as a reverb process part (reverberation process part) configured to perform a reverb process on microphone signals. As the reverb process, a so-called "sampling reverb" has high realistic sensations. In the "sampling reverb", an impulse response between two points at which sounds are measured at any actual locations is convolved as it is (computation in a frequency region is equivalent to multiplication of a transfer function). Alternatively, to simplify a calculation resource, it is also possible to use a filer obtained by approximating a part or all of the sampling reverb by an infinite impulse response (IIR). Such an impulse response is also obtained through simulation. For example, a reverb type database (DB) 408 illustrated in FIG. 4 stores impulse responses corresponding to a plurality of reverb types obtained by measuring sounds at any locations such as a concert hall, a movie theater, and the like. Users are capable of selecting optimal impulse responses from among the impulse responses corresponding to the plurality of reverb types. Note that, it is possible to perform the convolution in a way similar to the above-described Patent Literature 1, and it is possible to use an FIR digital filter or a convolver. In this case, it is possible to have a plurality of filter coefficients for reverb, and it is possible for a user to select any filter coefficient. At this time, by using an impulse response (IR) that is measured or simulated in advance, the user can feel a sound field of a location other than a location where the user is actually present, in accordance with an event such as emission of a sound that is created around the user (such as speech from someone, fall of something, or emission of a sound from the user himself/herself). With regard to recognition of a size of a space, it is also possible for the user to feel a place where the IR is measured, through auditory sensation.

2. Reverb Process According to Present Embodiment

Figure 6:
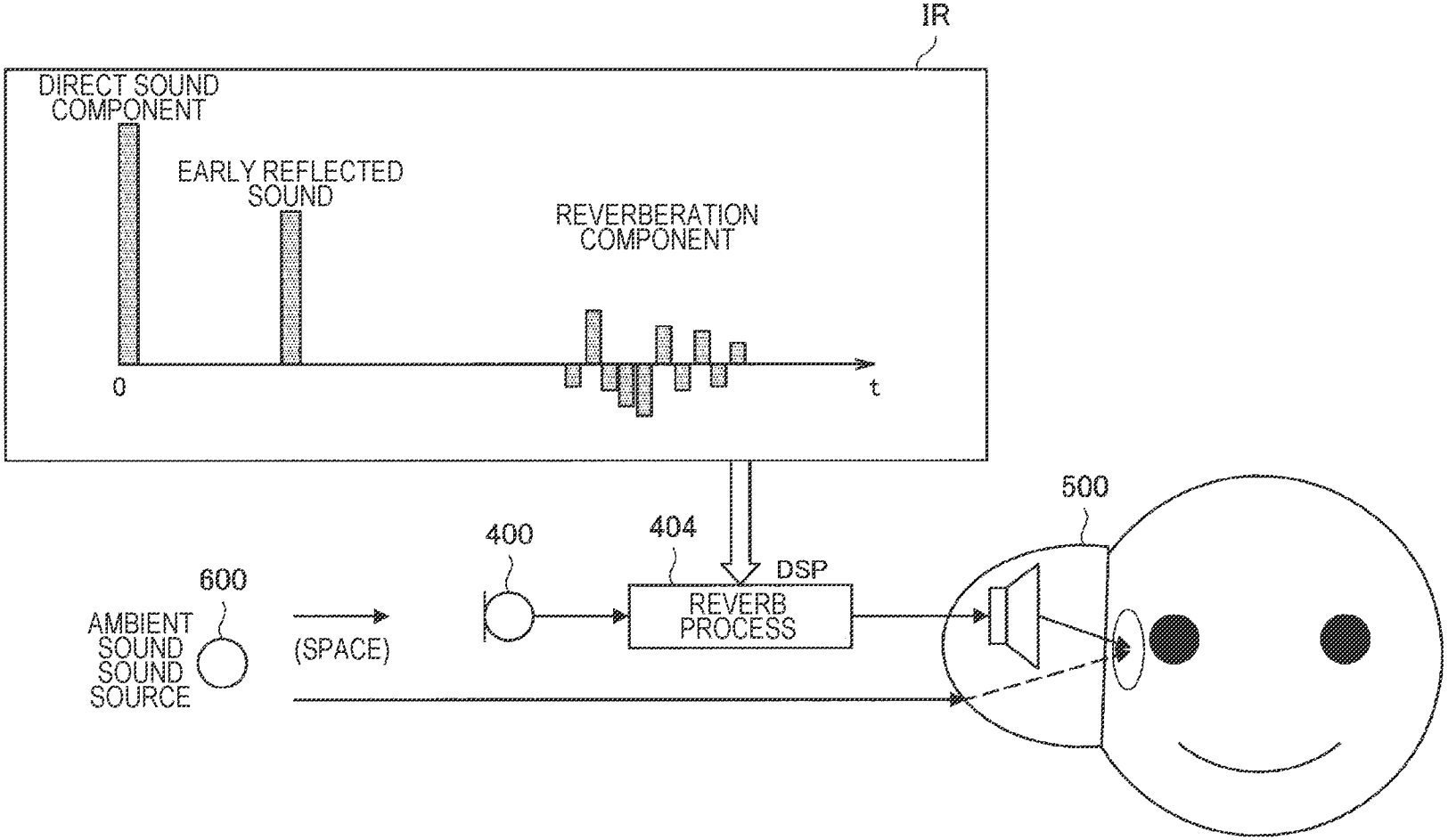
FIG. 6 is a schematic diagram illustrating a process system configured to provide a user experience related to sounds subjected to a reverb process by using a general microphone and general "closed-style" headphones such as in-ear headphones.

Next, details of the reverb process according to the embodiment will be described. First, with reference to FIG. 6 and FIG. 7, a process system for providing a user experience by using a general microphone 400 and general "closed-style" headphones 500 such as in-ear headphones, will be described. The configuration of the headphones 500 illustrated in FIG. 6 is similar to the sound output device 100 illustrated in FIG. 4 except the headphones 500 are "closed-style" headphones. The microphones 400 are installed near the left and right headphones 500. In this case, the closed-style headphones 500 are assumed to have high noise isolation performances. Here, to simulate a specific sound field space, it is assumed that an impulse response IR illustrated in FIG. 6 is already measured. As illustrated in FIG. 6, a sound output from a sound source 600 is collected by the microphone 400, and the IR itself including the direct sound component is convolved into a microphone signal from the microphone 400 by the DSP 404 as the reverb process. Therefore, it is possible for the user to feel the specific sound field space. Note that, in FIG. 6, illustrations of the microphone amplifier/ADC 402 and the DAC/amplifier 406 are omitted.

However, although the headphones 500 are the closed-style headphones, the headphones 500 often fail to achieve sufficient sound isolation performances especially with regard to low frequencies. Therefore, a part of sounds may enter inside through a housing of the headphone 500, and a sound that is a leftover component from the sound isolation may reach an eardrum of the user.

Figure 7:
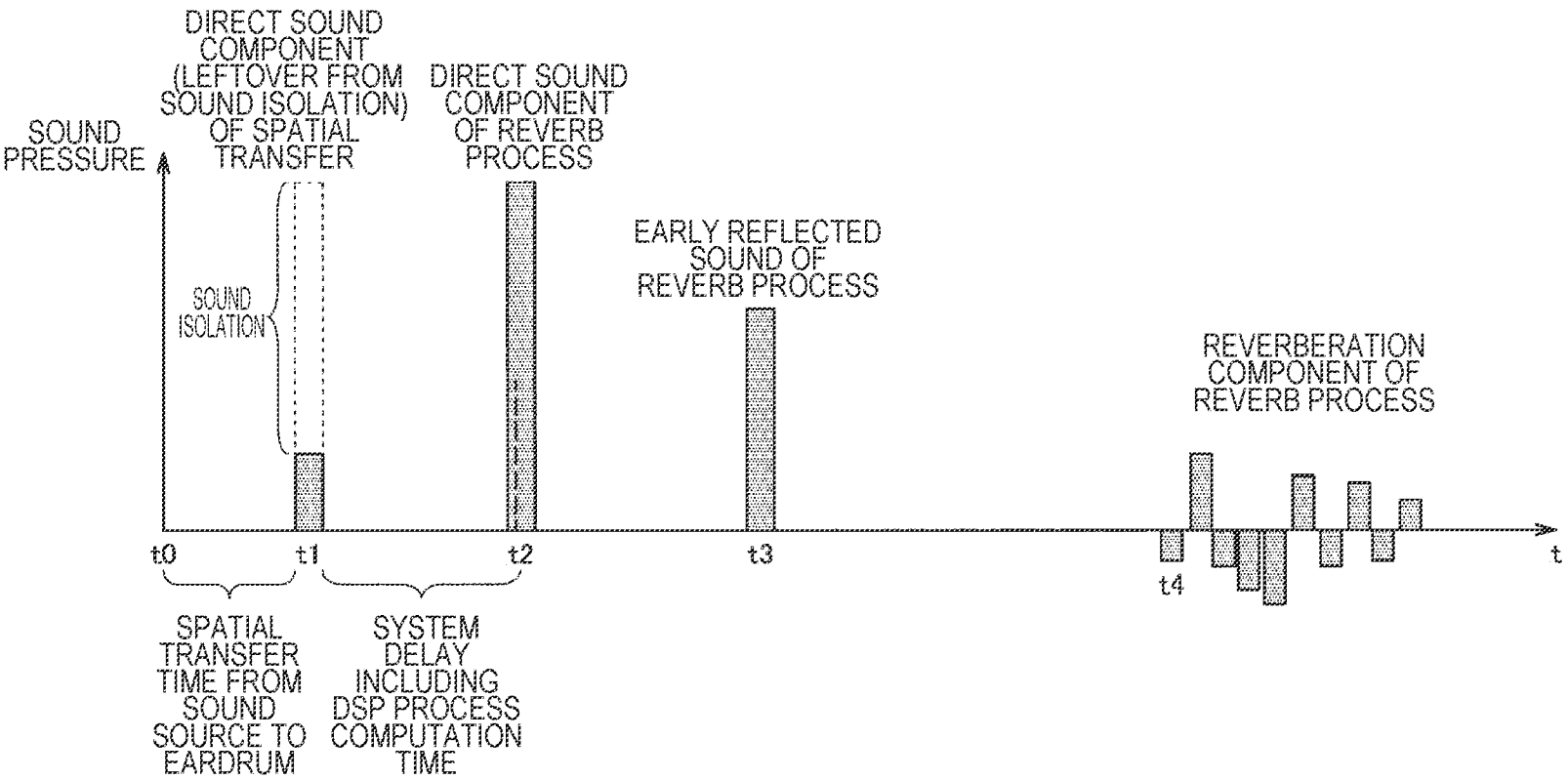
FIG. 7 is a schematic diagram illustrating a response image of a sound pressure on an eardrum when a sound output from a sound source is referred to as an impulse and spatial transfer is set to be flat in the case of FIG. 6.

FIG. 7 is a schematic diagram illustrating a response image of a sound pressure on an eardrum when a sound output from the sound source 600 is referred to as an impulse and spatial transfer is set to be flat. As described above, the closed-style headphones 500 have high sound isolation performances. However, with regard to a partial sound that has not been isolated, a direct sound component (leftover from the sound isolation) of the spatial transfer remains, and the user hears a little bit of the partial sound. Next, a response sequence of impulse responses IRs illustrated in FIG. 6 is observed successively after elapse of a process time of a convolution (or FIR) operation performed by the DSP 404, and elapse of a time of "system delay" caused in the ADC and DAC. In this case, there are possibilities that the direct sound component of the spatial transfer is heard as the leftover from the sound isolation, and a feeling of strangeness is occurred by overall system delay. More specifically, with reference to FIG. 7, a sound is generated from the sound source 600 at a time t0. After elapse of a spatial transfer time from the sound source 600 to an eardrum, a user can hear a direct sound component of the spatial transfer (time t1). The sound heard by the user at the time t1 is a leftover sound from the sound isolation. The leftover sound from the sound isolation means a sound that has not been isolated by the closed-style headphone 500. Next, after elapse of the time of "system delay" described above, the user can hear a direct sound component subjected to a reverb process (time t2). As described above, the user hears the direct sound component of the spatial transfer and then hears the direct sound component subjected to the reverb process. This may provide the user with a feeling of strangeness. Next, the user hears an early reflected sound subjected to the reverb process (time t3), and hears a reverberation component subjected to the reverb process after a time t4. Therefore, all of the sounds subjected to the reverb process are delayed due to the "system delay", and this may provide the user with a feeling of strangeness. In addition, even if the headphone 500 completely isolates an external sound, disconnect may occur between a sense of vision and a sense of hearing of the user, due to the above-described "system delay". In FIG. 7, the sound is generated from the sound source 600 at the time t0. However, in the case where the headphones 500 has succeeded in complete isolation of the external sound, the user first hears the direct sound component subjected to the reverb process as a direct sound component. This causes the disconnect between the sense of vision and the sense of hearing of the user. Examples of the disconnect between the sense of vision and the sense of hearing of the user include a mismatch between an actual mouth movement of a conversation partner and a voice corresponding to the mouth movement (lip sync).

There is a possibility that the above-described feeling of strangeness occurs. However, according to the configuration of the embodiment illustrated in FIG. 6 and FIG. 7, it is possible to add a desired reverberation to a sound acquired in real time by the microphone 400. Therefore, it is possible to cause a listener to hear a sound of a different sound environment.

Figure 8:
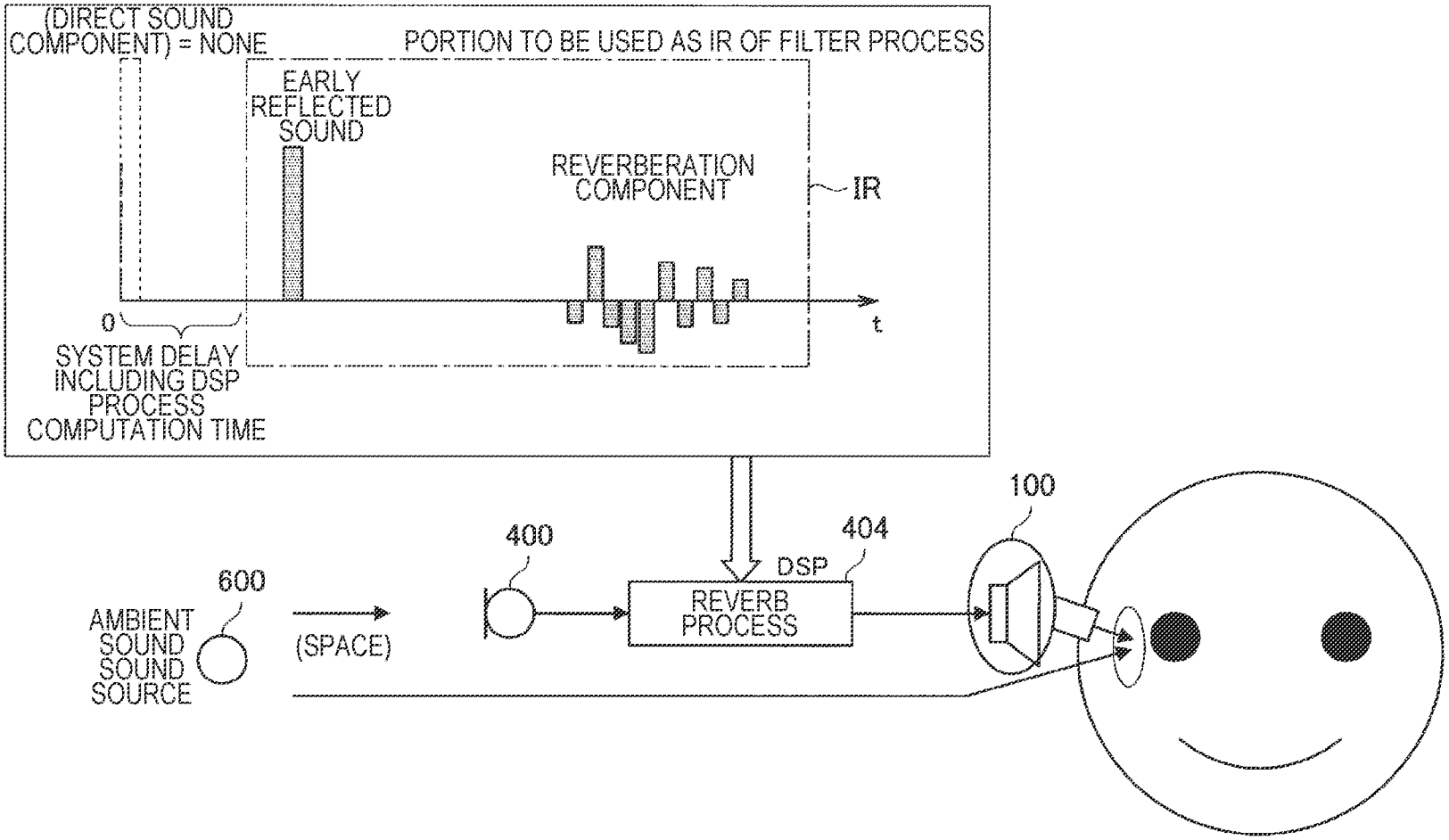
FIG. 8 is a schematic diagram illustrating a case where "ear-open-style" sound output devices are used and an impulse response IR in the same sound field environment as FIG. 6
Figure 9:
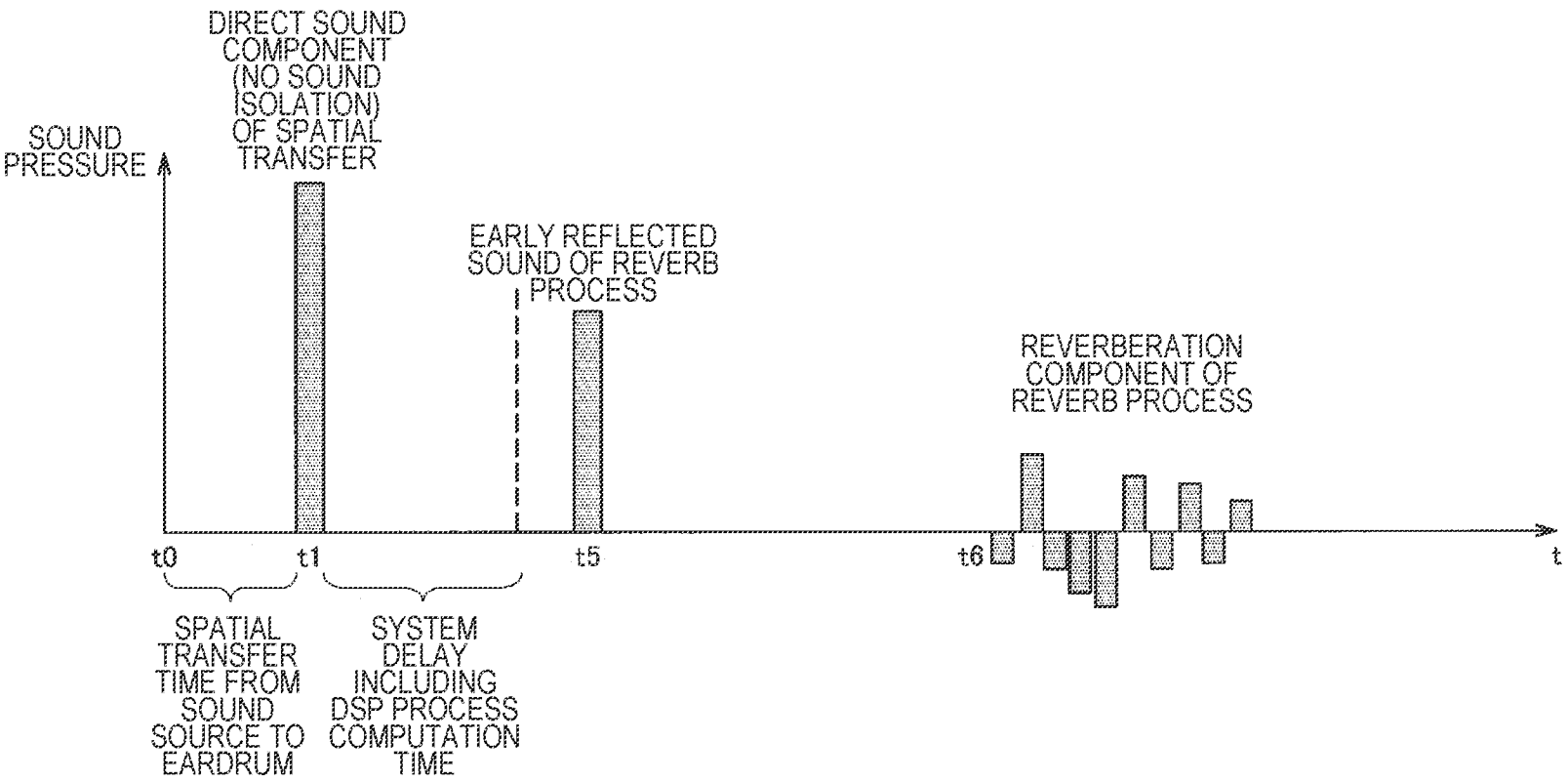
FIG. 9 is a schematic diagram illustrating a response image of a sound pressure on an eardrum when a sound output from a sound source is referred to as an impulse and spatial transfer is set to be flat in the case of FIG. 8.

FIG. 8 and FIG. 9 are schematic diagrams illustrating a case where "ear-open-style" sound output devices 100 are used and an impulse response IR in the same sound field environment as FIG. 6 and FIG. 7 is used. Here, FIG. 8 corresponds to FIG. 6, and FIG. 9 corresponds to FIG. 7. First, as illustrated in FIG. 8, the embodiment does not use the direct sound components as the convolution component of the DSP 404, among the impulse responses illustrated in FIG. 6. This is because, in the case of using the "ear-open-style" sound output devices 100 according to the embodiment, the direct sound components enter the ear canals as it is through a space. Therefore, the "ear-open-style" sound output devices 100 do not have to create the direct sound components through computation performed by the DSP 404 and the headphone reproduction, in comparison with the closed-style headphones 500 illustrated in FIG. 6 and FIG. 7.

Therefore, as illustrated in FIG. 8, a portion (region boxed by a dash-dotted line in FIG. 8) obtained by subtracting information of time of the system delay including the DSP process computation time from the original impulse response IR of the specific sound field (IR illustrated in FIG. 6) is used as an impulse response IR' that is actually used for a convolution operation. The information of time of the system delay is generated in an interval between the measured direct sound component to the early reflected sound.

In a way similar to FIG. 7, FIG. 9 is a schematic diagram illustrating a response image of a sound pressure on an eardrum when a sound output from the sound source 600 is referred to as an impulse and spatial transfer is set to be flat in the case of FIG. 8. As illustrated in FIG. 9, when a sound is generated from the sound source 600 at a time t0, a spatial transfer time (t0 to t1) from the sound source 600 to an eardrum is generated in a way similar to FIG. 7. However, since the "ear-open-style" sound output devices 100 are used, a direct sound component of the spatial transfer is observed on the eardrum at the time t1. Subsequently, an early reflected sound due to a reverb process is observed on the eardrum at a time t5, and a reverberation component due to a reverb process is observed on the eardrum after a time t6. In this case, as illustrated in FIG. 8, the time corresponding to the system delay is subtracted in advance on the IR to be convolved. Therefore, the user is capable of hearing the early reflected sound of the reverb process at an appropriate timing after hearing the direct sound component. In addition, since the early reflected sound of the reverb process is a sound corresponding to a specific sound field environment, it is possible for a user to enjoy a sound field feeling as if the user were at another real location corresponding to the specific sound field environment. It is possible to absorb the system delay by subtracting information of time of the system delay occurred in an interval between the direct sound component and the early reflected sound, from the original impulse response IR of the specific sound field. Therefore, it is possible to alleviate a necessity of a low-delay system and a necessity of operating a calculation resource of the DSP 404 faster. Therefore, it is possible to reduce a size of the system, and it is possible to simplify the system configuration. Accordingly, it is possible to obtain large practical effects such as significantly reducing manufacturing costs.

In addition, as illustrated in FIG. 8 and FIG. 9, the user does not hear the direct sound twice when using the system according to the embodiment, in comparison with the system illustrated in FIG. 6 and FIG. 7. It is possible to significantly improve consistency in entire delay, and it is also possible to avoid deterioration in sound quality due to interference between an unnecessary leftover component from sound isolation and a direct sound component due to the reverb process, although the deterioration occurs in FIG. 6 and FIG. 7.

In addition, humans can easily distinguish whether a direct sound component is a real sound or an artificial sound on the basis of resolution and frequency characteristics, in comparison with a reverberation component. In other words, a sound reality is important especially for the direct sound since it is easy to determine whether the direct sound is a real sound or an artificial sound. The system according to the embodiment illustrated in FIG. 8 and FIG. 9 uses the "ear-open-style" sound output device 100. Therefore, the direct sound that reaches an ear of a user is a direct "sound" itself generated by the sound source 600. In principle, this sound is not deteriorated due to the computation process, the ADC, the DAC, or the like. Therefore, the user can feel strong realistic sensations when hearing the real sound.

Note that, it can be said that the configuration of the impulse response IR' that considers the system delay illustrated in FIG. 8 and FIG. 9 is a system that is capable of effectively using a time interval between the direct sound component and the early reflected sound component in the impulse response IR' illustrated in FIG. 6, as a delay time of a DSP calculation process, the ADC, or the DAC. It is possible to establish such a system since the ear-open-style sound output device 100 transmits a direct sound as it is to an eardrum. It is impossible to establish such a system when using a "closed-style" headphones. In addition, even if it is impossible to use a low-delay system capable of performing a high-speed process, it is possible to provide a user experience as if a user were in a different space, by subtracting information of time of system delay generating in an interval between the direct sound component and the early reflected sound from an original impulse response IR of the specific sound field. Therefore, it is possible to provide an innovative system with a low cost.

3. Application Example of System According to Present Embodiment

Figure 10:
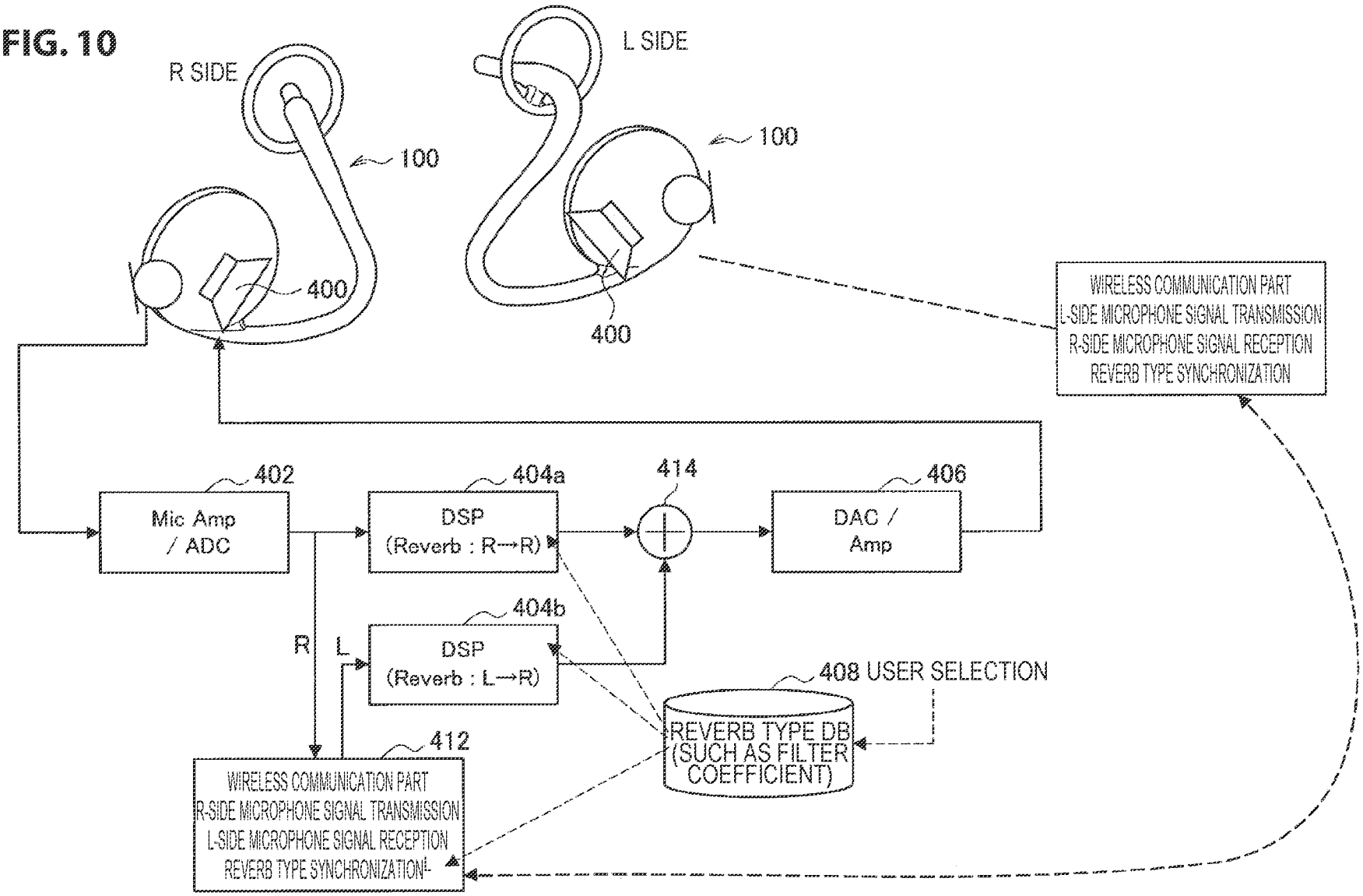
FIG. 10 is a schematic diagram illustrating an example in which higher realistic sensations are obtained by applying the reverb process.

Next, an application example of the system according to the embodiment will be described. FIG. 10 illustrates an example in which higher realistic sensations is obtained by applying the reverb process. FIG. 10 illustrates a right (R) side system. In addition, the left (L) side has a system configuration that is a mirror image of the right (R) side system illustrated in FIG. 10. In general, the L-side reproduction device is independent from the R-side reproduction device, and they are not connected in a wired manner. In the configuration example illustrated in FIG. 10, the L-side sound output device 100 and the R-side sound output device 100 are connected via wireless communication parts 412, and two-way communication is established. Note that, the two-way communication may be established between the L-side sound output device 100 and the R-side sound output device 100 via a repeater such as a smartphone.

The reverb process illustrated in FIG. 10 achieves a stereo reverb. With regard to the reproduction performed by the right side sound output device 100, different reverb processes are performed on the respective microphone signals of the right side microphone 400 and the left side microphone 400, and an addition of the microphone signals is output as reproduction. In a similar way, with regard to the reproduction performed by the left side sound output device 100, different reverb processes are performed on the respective microphone signals of the left side microphone 400 and the right side microphone 400, and an addition of the microphone signals is output as reproduction.

In FIG. 10, a sound collected by an L-side microphone 400 is received by an R-side wireless communication part 412, and subjected to a reverb process performed by a DSP 404*b*. On the other hand, a sound collected by the R-side microphone 400 undergoes amplification performed by the microphone amplifier/ADC 402, undergoes AD conversion, and undergoes a reverb process performed by a DSP 404*a*. The left and right microphone signals subjected to the reverb processes are added by an adder (superimposition part) 414. This enables superimposing a sound heard by one of the ears on the other ear side. Therefore, it is possible to enhance realistic sensations in the case of hearing sounds that reflect right and left, for example.

In FIG. 10 exchange of L-side microphone signals and R-side microphone signals are performed via Bluetooth (registered trademark) (LE), Wi-Fi, a communication scheme such as a unique 900 MHz, Near-Field Magnetic Induction (NFMI used in hearing aids or the like), infrared communication, or the like. Alternatively, the exchange may be performed in a wired manner. In addition, it is desirable for the left side and the right side to share (synchronize) not only the microphone signals but also information regarding a reverb type selected by the user.

Next, an example in which head-mounted display (HMD) display is combined on the basis of a video content will be described. In examples illustrated in FIG. 11 and FIG. 12, content is stored in a medium (such as a disc or memory), for example. Examples of the content include content transmitted from a cloud and temporarily stored in a local-side device. Such content includes content with high interactive characteristics such as a game. In the content, a video portion is displayed on the HMD 600 via a video process part 420. In this case, when a scene in the content indicates a place with a large reverberation such as a church or a hall, it is considered that a reverb process may be performed on voice of people or sound of objects in that place offline during producing the content, or a reverb process (rendering) may be performed on a reproduction device side. However, in this case, a sense of immersion into the content is deteriorated when hearing voice of the user himself/herself or a real sound around the user.

The system according to the embodiment analyzes video, sound, or metadata that are included in the content, estimates a sound field environment used in the scene, and then matches voice of the user himself/herself and a real sound around the user with the sound field environment corresponding to the scene. A scene control information generation part 422 generates scene control information corresponding to the estimated sound field environment or a sound field environment designated by the metadata. Next, a reverb type that is closest to the sound field environment is selected from the reverb type database 408 in accordance with the scene control information, and a reverb process is performed by the DSP 404 on the basis of the selected reverb type. The microphone signal subjected to the reverb process is input to an adder 426, convolved into sound of the content processed by a sound/audio process part 424, and then reproduced by the sound output device 100. In this case, the signal convolved into the sound of the content is a microphone signal subjected to a reverb process corresponding to a sound field environment of the content. Therefore, in the case where a sound event occurs such as own voice is output or a real sound is generated around the user while viewing the content, the user hears the own voice and the real sound with reverberation and echo corresponding to the sound field environment indicated in the content. This enables the user himself/herself to feel as if the user were present in the sound field environment of the provided content, and it is possible for the user to become deeply immersed in the content.

Figure 11:
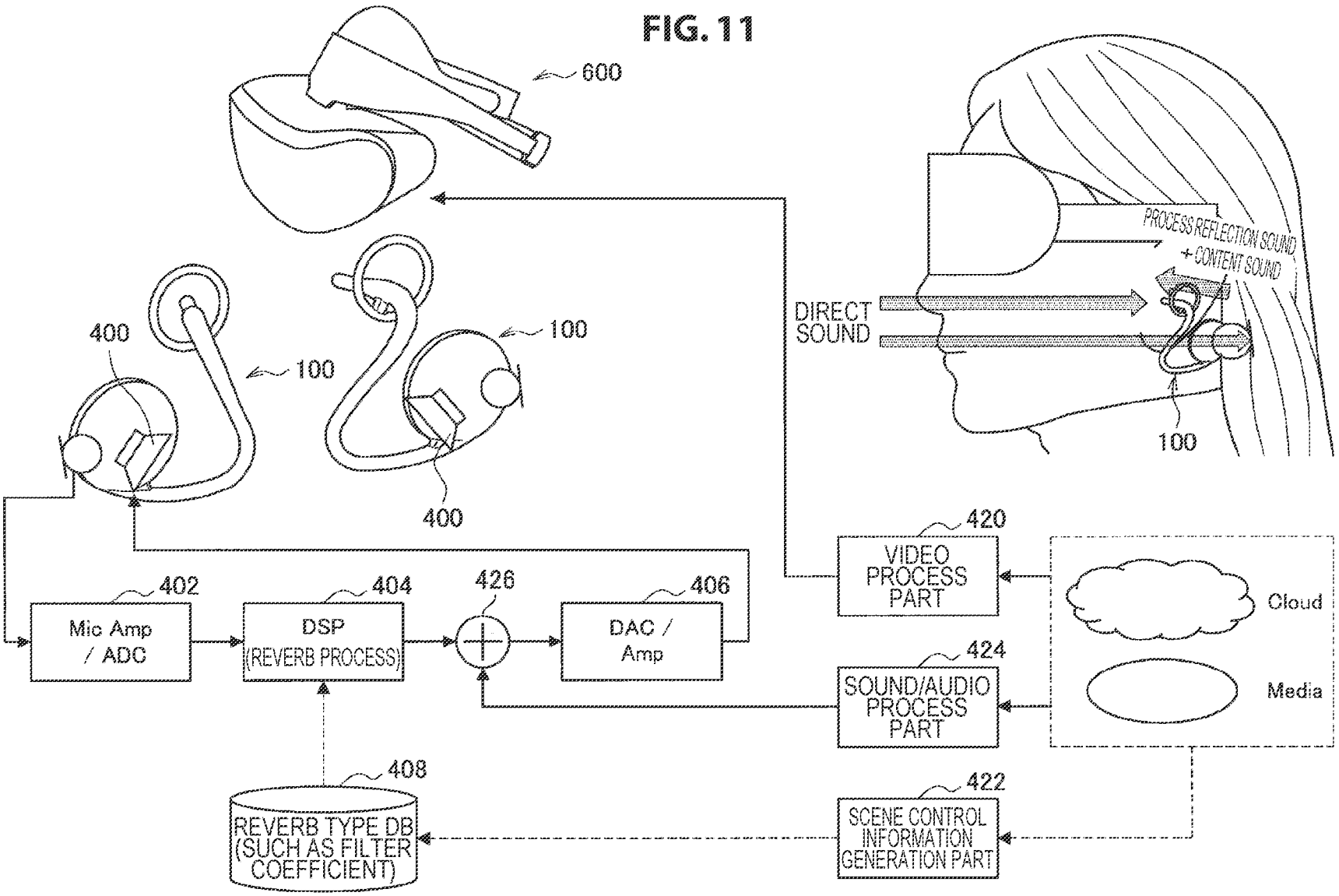
FIG. 11 is a schematic diagram illustrating an example in which HMD display is combined on the basis of a video content.

FIG. 11 assumes a case where the HMD 600 displays content that is created in advance. Examples of the content include a game and the like. On the other hand, examples of a use case similar to FIG. 11 include a system configured to display real scenery (environment) around the device on the HMD 600 by providing the HMD 600 with a camera or the like or by using a half mirror, and provide a see-through experience or an AR system by displaying an CG object superimposed on the real scenery (environment), for example.

Figure 12:
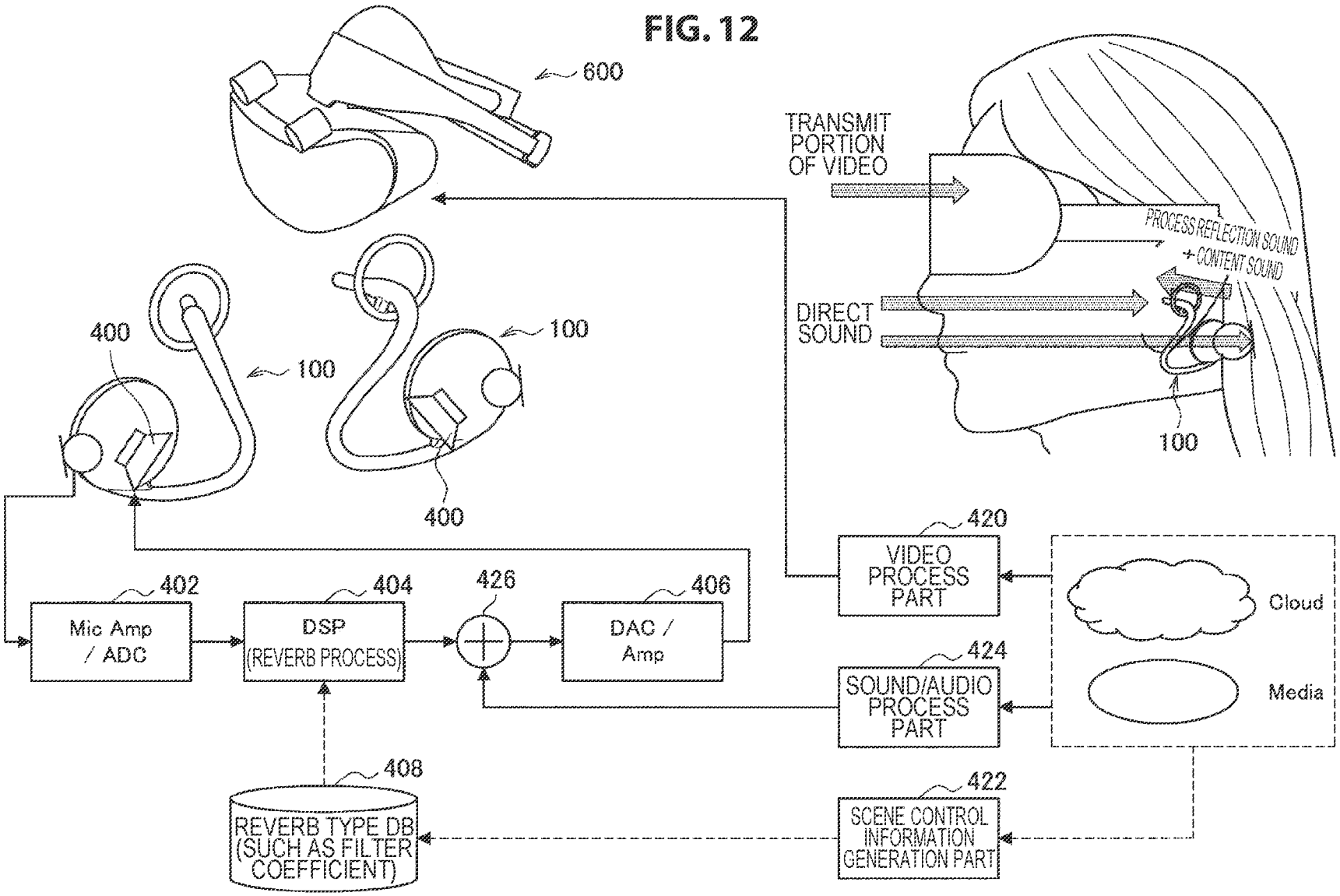
FIG. 12 is a schematic diagram illustrating an example in which HMD display is combined on the basis of a video content.

Even in such a case, it is possible to create a sound field environment by using a system similar to FIG. 11 when the user wants to create the sound field environment different from the real location on the basis of video of an ambient situation, for example. In this case, as illustrated in FIG. 12, the user is viewing an ambient situation (such as fall of something, a speech from someone), unlike the example in FIG. 11. Therefore, it is possible to obtain a vision and a sound field expression based on the ambient situation (ambient environment), and it is possible to obtain more realistic vision and sound field expression. Note that, the system illustrated in FIG. 11 and the system illustrated in FIG. 12 are the same.

Figure 13:
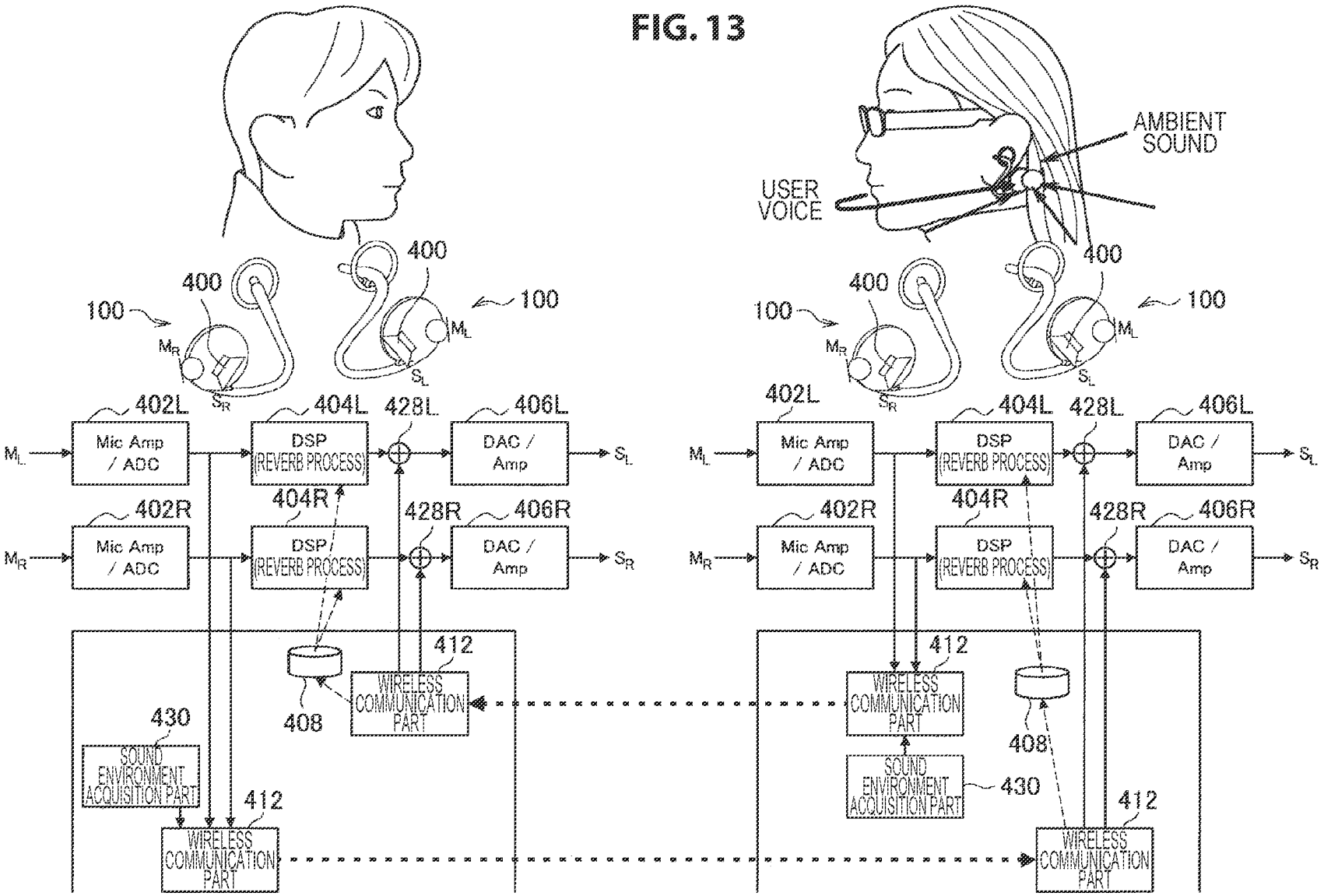
FIG. 13 is a schematic diagram illustrating a case of talking on the phone while sharing sound environments of phone call partners.

Next, a case where a plurality of users make communication or make a phone call by using the sound output devices 100 according to the embodiment will be described. FIG. 13 is a schematic diagram illustrating a case of talking on the phone while sharing sound environments of phone call partners. This function can be turned on and off by users. In the above-described configuration example, the reverb type is set by the user himself/herself or designated or estimated by the content. However, FIG. 13 assumes a phone call between two people using the sound output devices 100, and the both people can experience sound field environments of his/her partners as if it were real.

In this case, a sound field environment of a partner side is necessary. It is possible to obtain the sound field environment of the partner side by analyzing a microphone signal collected by a microphone 400 of the partner side of the phone call, or it is also possible to obtain a degree of reverberation by estimating a building or a location where the partner is present from map information obtained via GPS. Accordingly, the both people making communication with each other transmits phone call voice and information indicating sound environments around themselves, to their partners. In a one user side, the reverb process is performed on echo of own voice on the basis of a sound environment obtained from the other user. This enables the one user to feel as if he/she spoke in a sound field where the other user (phone call partner) is present.

In FIG. 13, when the user makes a phone call and transmits his/her voice to a partner, a left microphone 400L and a right microphone 400R collect the user's voice and an ambient sound, and microphone signals are processed by a left microphone amplifier/ADC 402L and a right microphone amplifier/ADC 402R, and transmitted to the partner side via the wireless communication parts 412. In this case, a sound environment acquisition part (sound environment information acquisition part) 430 obtains a degree of reverberation by estimating a building or a location where the partner is present from map information obtained via GPS, and acquires it as sound environment information, for example. The wireless communication part 412 transmits the microphone signal and the sound environment information acquired by the sound environment acquisition part 430, to the partner side. In the partner side receiving the microphone signal, a reverb type is selected from the reverb type database 408 on the basis of the sound environment information received with the microphone signal. Next, the reverb processes are performed on the own microphone signal by using a left DSP 404L and a right DSP 404R 404, and the microphone signal received from the partner side is convolved into the signal subjected to the reverb process, by using adders 428R and 428L.

Accordingly, one of the users performs the reverb process on the ambient sound including own voice in accordance with a sound environment of the partner side on the basis of the sound environment information of the partner side. On the other hand, the adders 428R and 428L add sound corresponding to the sound environment of the partner side to the sound of the partner side. Therefore, the user can feel as if he/she were making a phone call in the same sound environment (such as a church or a hall) as the partner side.

Note that, in FIG. 13, connection between the wireless communication parts 412 and the microphone amplifiers/ADCs 402L and 402R, connection between the wireless communication parts 412 and the adders 428L and 428R are established in a wired or wireless manner. In the case of the wireless manner, short-range wireless communication such as Bluetooth (registered trademark) (LE), NFMI, or the like can be used. The short-range wireless communication may be relayed by a repeater.

Figure 14:
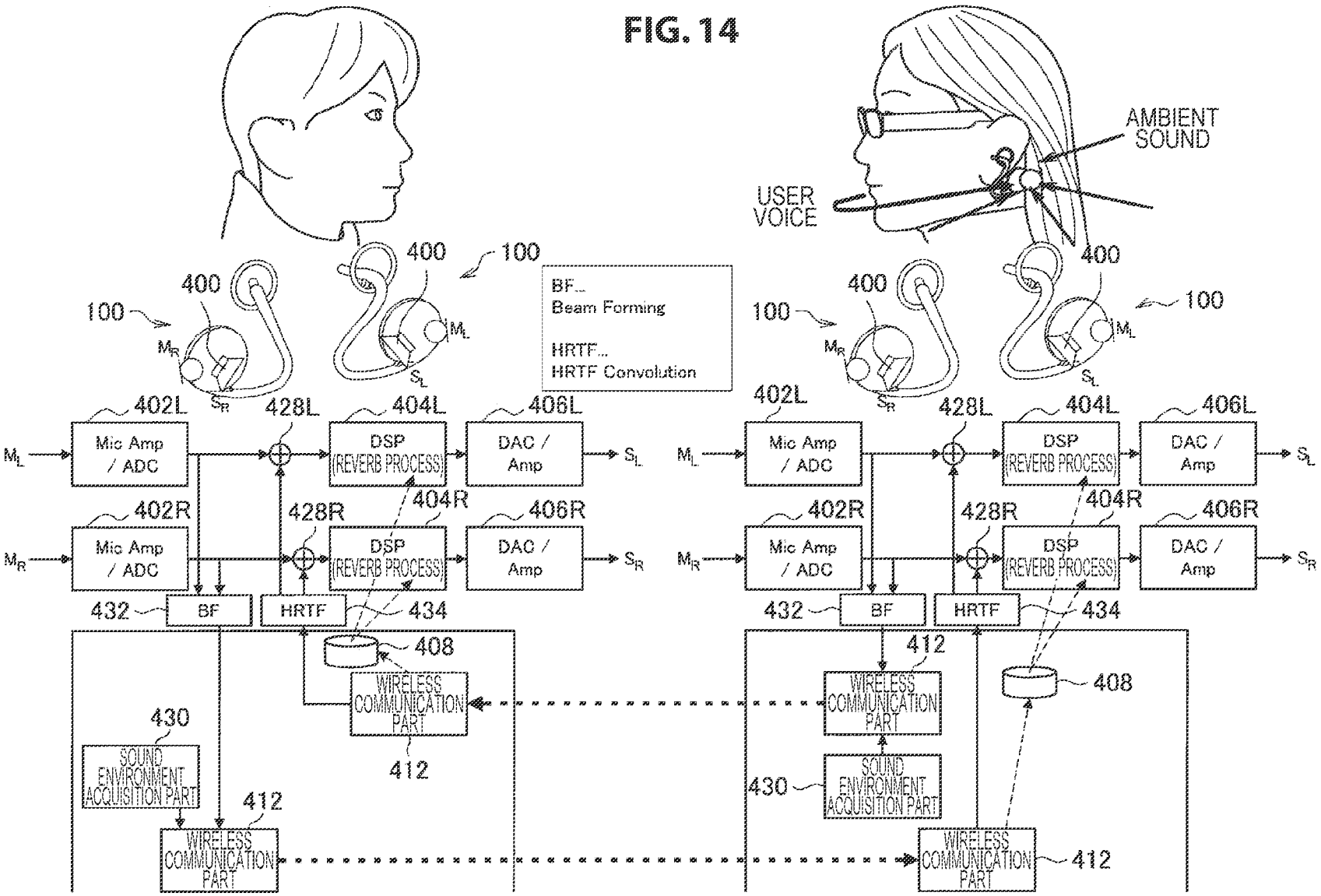
FIG. 14 is a schematic diagram illustrating an example of extracting own voice to be transmitted as a monaural sound signal through a beamforming technology.

On the other hand, as illustrated in FIG. 14, own voice to be transmitted may be extracted as a monaural sound signal while focusing on voice, by using beamforming technology or the like. The beamforming is performed by beamforming parts (BF) 432. In this case, it is possible to transmit voice monaurally. Therefore, the system illustrated in FIG. 14 has advantage that wireless bands are not used, in comparison with FIG. 13. In this case, when the L and R reproduction devices on the voice-receiving side monaurally reproduce the voice as it is, lateralization occurs, and the user hears unnatural voice. Therefore, in the voice transmission signal receiving side, a head-related transfer function (HRTF) is convolved by the HRTF part 434, and a virtual sound is localized at any location, for example. Therefore, it is possible to localize a sound image outside the head. A sound image location of a partner may be set in advance, may be arbitrarily set by a user, or may be combined with video. Therefore, for example, it is possible to provide an experience such that a sound image of a partner is localized next to the user. Of course, it is also possible to additionally provide a video expression as if the phone call partner were present next to the user.

In an example illustrated in FIG. 14, the adders 428L and 428R add sound signals obtained after the virtual sound image localization, to the microphone signals, and perform the reverb processes. This enables to convert the sounds after the virtual sound image localization to the sound of the sound environment of the communication partner.

Figure 15:
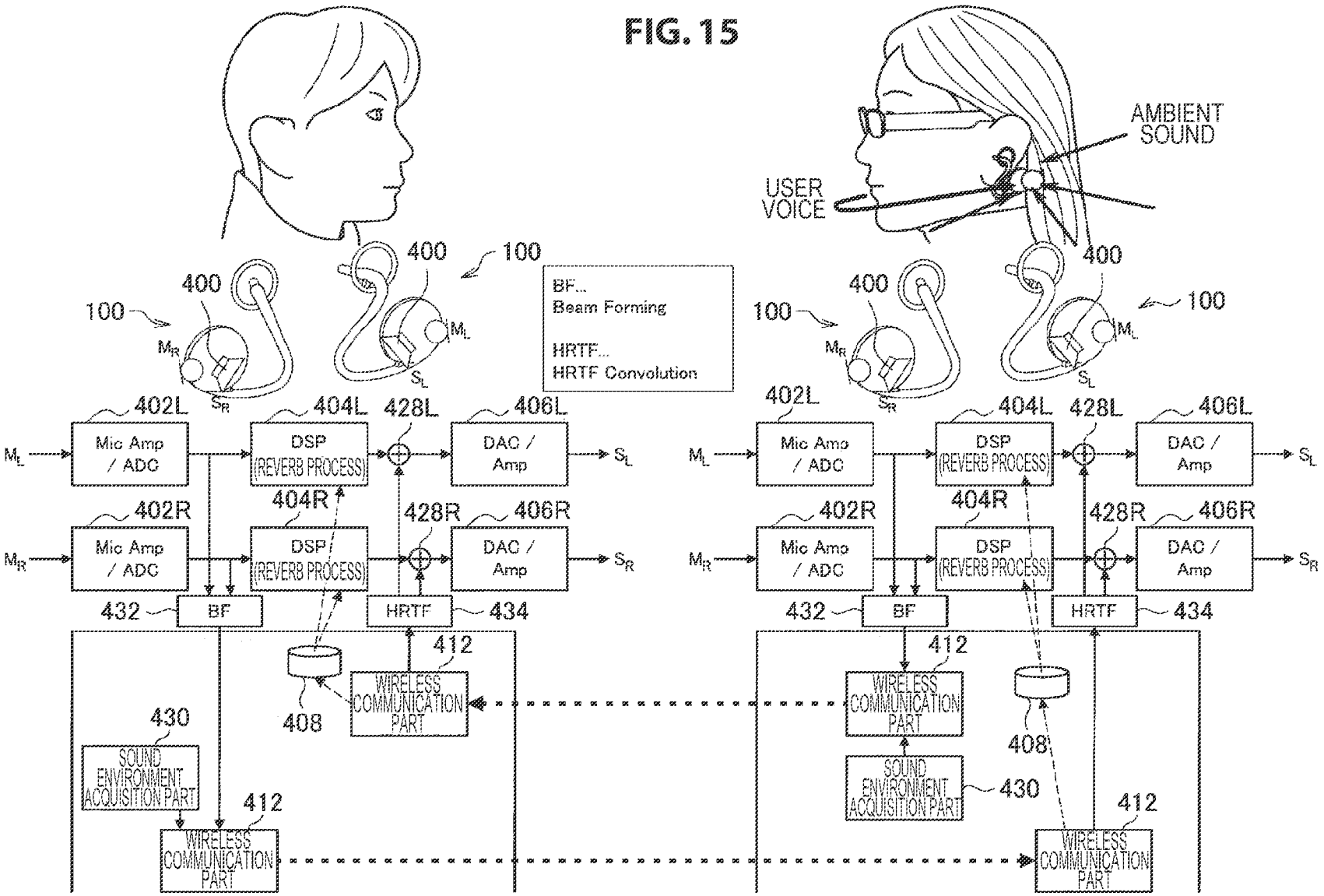
FIG. 15 is a schematic diagram illustrating an example of adding a sound signal obtained after localizing a virtual sound image, to a microphone signal obtained after a reverb process.

On the other hand, in an example illustrated in FIG. 15, the adders 428L and 428R add sound signals obtained after the virtual sound image localization to the microphone signals obtained the reverb process. In this case, the sound obtained after the virtual sound image localization does not correspond to the sound environment of the communication partner. However, it is possible to clearly distinguish sound of the communication partner by localizing a sound image at a desired location.

Figure 16:
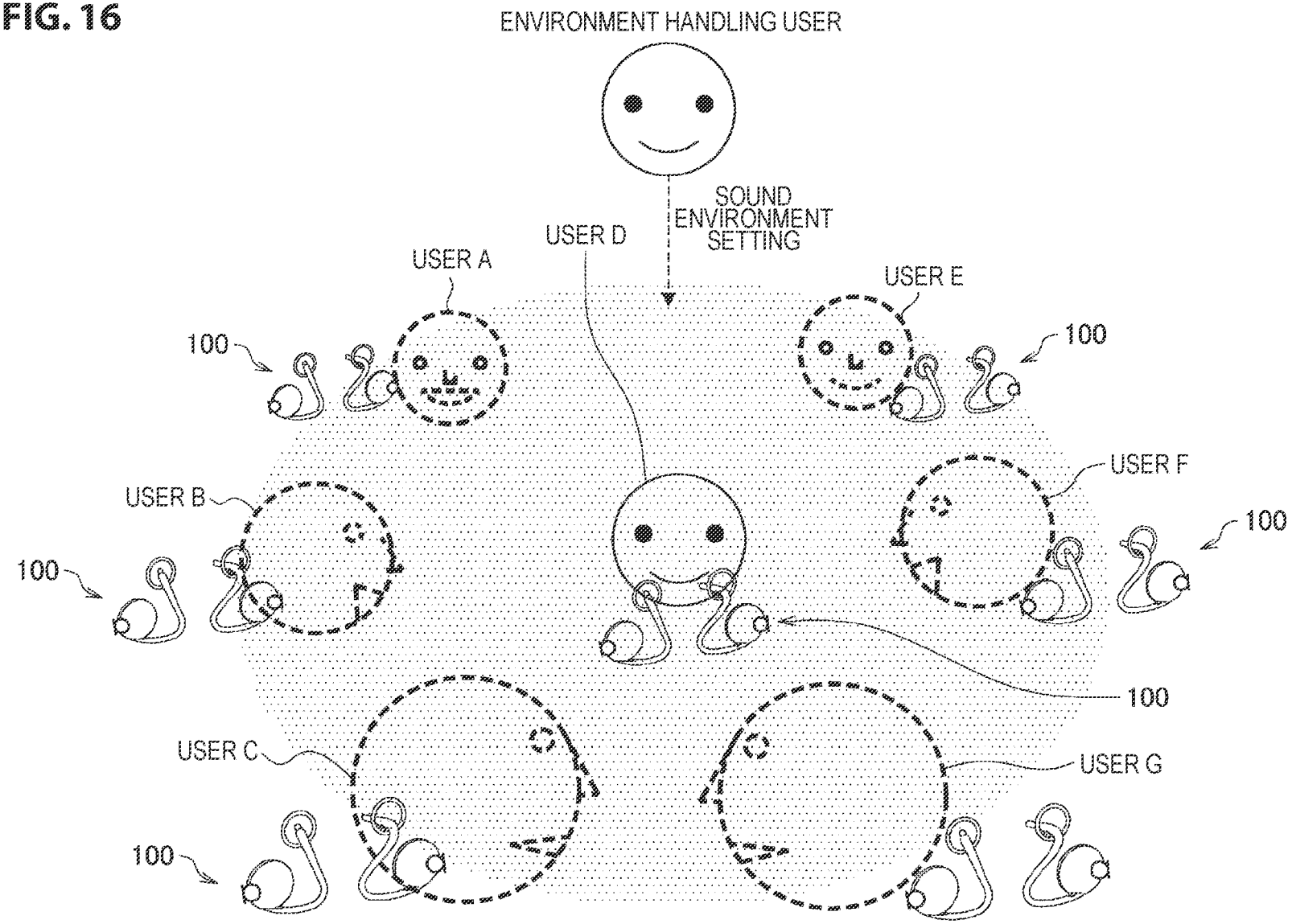
FIG. 16 is a schematic diagram illustrating an example of many people talking on the phone.
Figure 17:
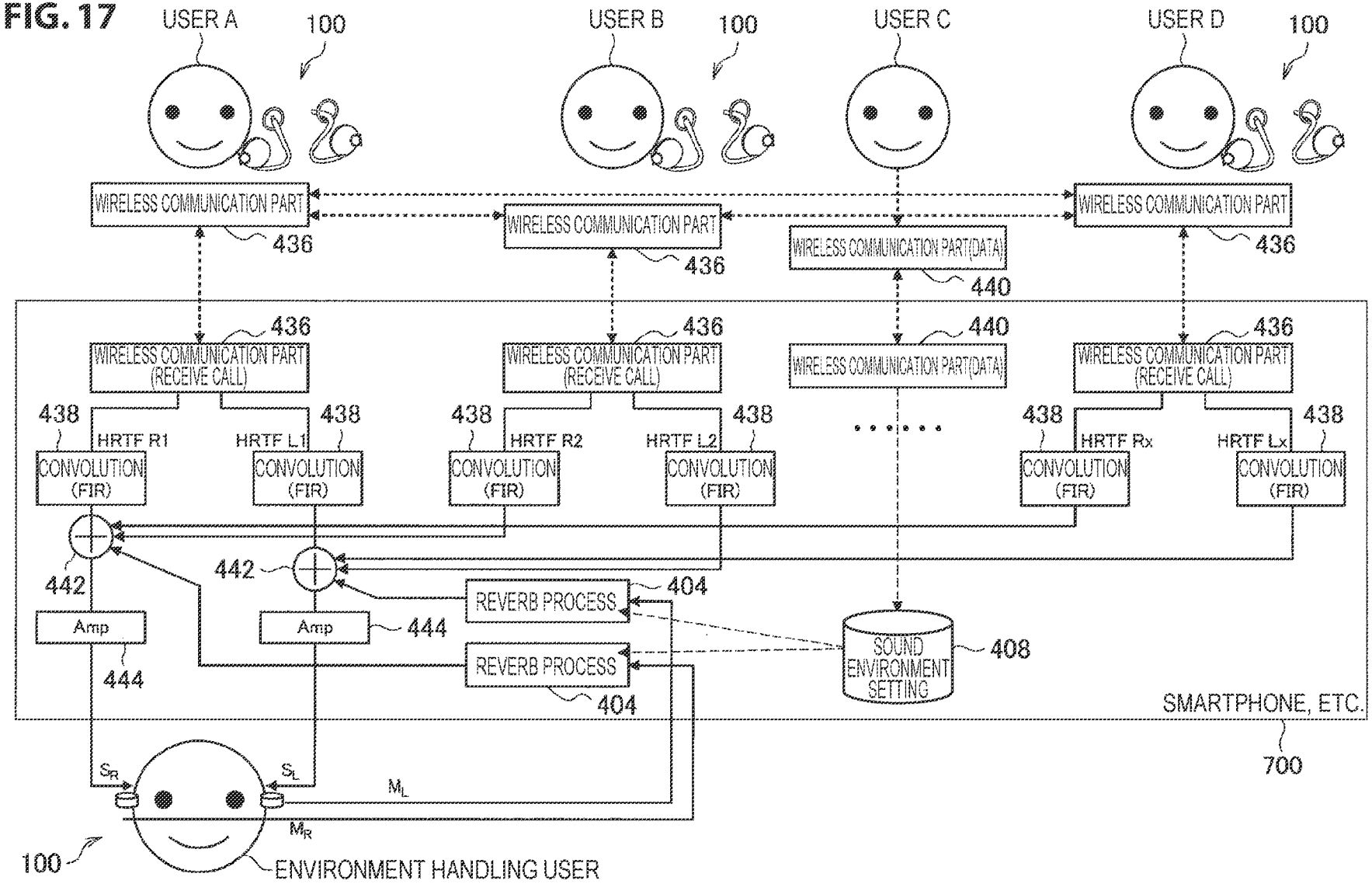
FIG. 17 is a schematic diagram illustrating the example of many people talking on the phone.

FIG. 14 and FIG. 15 assume the phone call between two people. However, it is possible to assume a phone call between many people. FIG. 16 and FIG. 17 are schematic diagrams illustrating the example of many people talking on the phone. For example, in this case, a person who starts a phone call serves as an environment handling user, and a sound field designated by the handling user is provided to everyone. This enables to provide an experience as if a plurality of people (environment handling user and users A to G) were talking in a specific sound field environment. The sound field set here does not have to be a sound field of someone included in the phone call targets. The sound field may be a sound field of a completely artificial virtual space. Here, to improve realistic sensations of the system, it is also possible for the respective people to set their avatars and use video assistance expression using HMDs or the like.

In the case of the many people, it is also possible to establish communication via wireless communication parts 436 by using electronic devices 700 such as smartphones as illustrated in FIG. 17. In the example illustrated in FIG. 17, the environment handling user transmits sound environment information for setting a sound environment to the wireless communication parts 440 of the electronic apparatus 700 of the respective users A, B, C, . . . . On the basis of the sound environment information, the electronic device 700 of the user A who has received the sound environment information sets an optimal sound environment included in the reverb type database 408, and performs reverb processes on microphone signals collected by the left and right microphones 400, by using the reverb process parts 404L and 404R.

On the other hand, the electronic devices 700 of the users A, B, C, . . . communicate with each other via the wireless communication parts 436. Filters (sound environment adjustment parts) 438 convolves an acoustic transfer function (HRTF/L and R) into voices of the other users received by the wireless communication part 436 of the electronic device 700 of the user A. It is possible to localize sound source information of the sound source 406 in a virtual space by convolving the HRTFs. Therefore, it is possible to spatially localize the sound as if the sound source information exists in a space same as the real space. The acoustic transfer functions L and R mainly include information regarding reflection sound and reverberation. Ideally, it is desirable to use a transfer function (impulse response) between appropriate two points (for example, between location of virtual speaker and location of ear) on an assumption of an actual reproduction environment or an environment similar to the actual reproduction environment. Note that it is possible to improve reality of the sound environment by defining the acoustic transfer functions L and R as different functions, for example, by way of selecting a different set of the two points for each of the acoustic transfer functions L and R, even if the acoustic transfer functions L and R are in the same environment.

For example, it is assumed that the users A, B, and C, . . . have a conference in respective rooms. By convolving the acoustic transfer functions L and R by using the filters 438, it is possible to hear voices as if they were carrying out the conference in the same room even in the case where the users A, B, C, . . . Are in remote locations.

Voices of the other users B, C, . . . are added by the adder 442, ambient sounds subjected to reverb processes are further added, amplification is performed by an amplifier 444, and then the voices are output from the sound output devices 100 to the ears of the user A. Similar processes are performed in the electronic devices 700 of the other users B, C, . . . .

In the example illustrated in FIG. 17, it is possible for the respective users A, B, C, to talk in sound environments set by the filters 438. In addition, it is possible to hear own voice and sounds in an environment around himself/herself as a sound in a specific sound environment set by the environment handling user.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below.

(1)

A sound output device including:

a sound acquisition part configured to acquire a sound signal generated from an ambient sound;

a reverb process part configured to perform a reverb process on the sound signal; and a sound output part configured to output a sound generated from the sound signal subjected to the reverb process, to a vicinity of an ear of a listener.

(2)

The sound output device according to (1), in which the reverb process part eliminates a direct sound component of an impulse response and performs the reverb process.

(3)

The sound output device according to (1) or (2), in which the sound output part outputs a sound to the other end of a sound guide part having a hollow structure with one end arranged near an entrance of an ear canal of a listener.

(4)

The sound output device according to (1) or (2), in which the sound output part outputs a sound in a state in which the ear of the listener is completely blocked from an outside.

(5)

The sound output device according to any of (1) to (4), in which the sound output part acquires the sound signals at a left ear side of a listener and a right ear side of the listener, respectively, the reverb process part includes a first reverb process part configured to perform a reverb process on the sound signal acquired by one of the left ear side and the right ear side of the listener, a second reverb process part configured to perform a reverb process on the sound signal acquired by the other of the left ear side and the right ear side of the listener, and a superimposition part configured to superimpose the sound signal subjected to the reverb process performed by the first reverb process part and the sound signal subjected to the reverb process performed by the second reverb process part, and the sound output part outputs a sound generated from the sound signal superimposed by the superimposition part.

(6)

The sound output device according to any of (1) to (5), in which the sound output part outputs a sound of content to an ear of a listener, and the reverb process part performs the reverb process in accordance with a sound environment of the content.

(7)

The sound output device according to (6), in which the reverb process part performs the reverb process on a basis of a reverb type selected on a basis of the sound environment of the content.

(8)

The sound output device according to (6), including a superimposition part configured to superimpose a sound signal of the content on the sound signal subjected to the reverb process.

(9)

The sound output device according to (1), including a sound environment information acquisition part configured to acquire sound environment information that indicates a sound environment around a communication partner, in which the reverb process part performs the reverb process on a basis of sound environment information.

(10)

The sound output device according to (9), including a superimposition part configured to superimpose a sound signal received from a communication partner on the sound signal subjected to the reverb process.

(11)

The sound output device according to (9), including:

a sound environment adjustment part configured to adjust a sound image location of a sound signal received from a communication partner; and a superimposition part configured to superimpose the signal whose sound image location is adjusted by the sound environment adjustment part, on the sound signal acquired by the sound acquisition part, in which the reverb process part performs a reverb process on the sound signal superimposed by the superimposition part.

(12)

The sound output device according to (9), including:

a sound environment adjustment part configured to adjust a sound image location of a monaural sound signal received from a communication partner; and a superimposition part configured to superimpose the signal whose sound image location is adjusted by the sound environment adjustment part, on the sound signal subjected to the reverb process.

(13)

A sound output method including:

acquiring a sound signal generated from an ambient sound;

performing a reverb process on the sound signal; and outputting a sound generated from the sound signal subjected to the reverb process, to a vicinity of an ear of a listener.

(14)

A program causing a computer to function as:

a means for acquiring a sound signal generated from an ambient sound;

a means for performing a reverb process on the sound signal; and a means for outputting a sound generated from the sound signal subjected to the reverb process, to a vicinity of an ear of a listener.

(15)

A sound system including:

a first sound output device including a sound acquisition part configured to acquire sound environment information that indicates an ambient sound environment, a sound environment information acquisition part configured to acquire, from a second sound output device, sound environment information that indicates a sound environment around the second sound output device that is a communication partner, a reverb process part configured to perform a reverb process on a sound signal acquired by the sound acquisition part, in accordance with the sound environment information, and a sound output part configured to output a sound generated from the sound signal subjected to the reverb process, to an ear of a listener; and the second sound output device including a sound acquisition part configured to acquire sound environment information that indicates an ambient sound environment, a sound environment information acquisition part configured to acquire sound environment information that indicates a sound environment around the first sound output device that is a communication partner, a reverb process part configured to perform a reverb process on a sound signal acquired by the sound acquisition part, in accordance with the sound environment information, and a sound output part configured to output a sound generated from the sound signal subjected to the reverb process, to an ear of a listener.

REFERENCE SIGNS LIST

100 sound output device
110 sound generation part
120 sound guide part
400 microphone
404 DSP
414, 426, 428L, 428R
430 sound environment acquisition part
438 filter

The invention claimed is:

1. A sound system, comprising:

a first sound output device; and a second sound output device configured to communicate with the first sound output device, wherein the first sound output device includes first circuitry configured to:

acquire a first sound signal generated from a first ambient sound around the first sound output device;

acquire first sound environment information that indicates a first ambient sound environment around the first sound output device;

acquire, from the second sound output device, second sound environment information that indicates a second ambient sound environment around the second sound output device;

reverberate the first sound signal based on the first sound environment information and the second sound environment information;

generate a first sound based on the reverberated first sound signal; and output the generated first sound to an ear of a first listener, wherein the generated first sound is output in a state in which the ear of the first listener is not completely blocked from an outside environment; and wherein the second sound output device includes second circuitry configured to:

acquire a second sound signal generated from a second ambient sound around the second sound output device;

acquire the second sound environment information that indicates the second ambient sound environment around the second sound output device;

acquire, from the first sound output device, the first sound environment information that indicates the first ambient sound environment around the first sound output device;

reverberate the second sound signal based on the second sound environment information and the first sound environment information;

generate a second sound based on the reverberated second sound signal; and output the generated second sound to an ear of a second listener, wherein the generated second sound is output in a state in which the ear of the second listener is not completely blocked from the outside environment.

* * * * *